US009320366B1

(12) United States Patent
Bertault et al.

(10) Patent No.: US 9,320,366 B1
(45) Date of Patent: Apr. 26, 2016

(54) PRODUCT STORAGE UNIT AND METHOD OF ARRANGEMENT

(71) Applicant: Spanx, Inc., Atlanta, GA (US)

(72) Inventors: Vincent Bertault, Orient, NY (US); Robert Kemp, Atlanta, GA (US)

(73) Assignee: Spanx, Inc., Atlanta, GA (US)

( * ) Notice: Subject to any disclaimer, the term of this patent is extended or adjusted under 35 U.S.C. 154(b) by 0 days.

(21) Appl. No.: 14/136,765

(22) Filed: Dec. 20, 2013

Related U.S. Application Data

(63) Continuation-in-part of application No. 29/465,880, filed on Sep. 3, 2013, now Pat. No. Des. 741,631.

(51) Int. Cl.
*A47F 1/12* (2006.01)
*A47F 5/00* (2006.01)

(52) U.S. Cl.
CPC ..... *A47F 1/12* (2013.01); *A47F 5/0025* (2013.01)

(58) Field of Classification Search
CPC ... A47F 5/0018; A47F 5/0025; A47F 5/0087; A47F 5/02; A47F 5/04; A47F 5/05; A47F 1/12; B42F 17/02; G09G 3/20
USPC ..... 211/11, 45, 50, 85.3, 131.1, 133.4, 188, 211/194, 196, 205; 108/103; 312/125, 135, 312/305; 40/124, 124.2, 649, 661; D6/675.1
See application file for complete search history.

(56) References Cited

U.S. PATENT DOCUMENTS 418,809 A * 1/1890 Mundy ..... 312/249.3
1,630,469 A * 5/1927 Cecil ..... 312/125
1,686,291 A * 10/1928 Moore ..... 108/101
1,755,477 A * 4/1930 Hunyady ..... 211/131.1
2,081,856 A * 5/1937 Frick ..... 211/131.1
2,229,171 A * 1/1941 Gritton ..... 108/60
2,327,742 A * 8/1943 Rosenberg ..... 211/131.1
2,526,246 A * 10/1950 Benjamin ..... 108/101
2,689,050 A * 9/1954 Albin ..... 108/101
2,740,684 A * 4/1956 Haralson ..... 312/319.5
2,750,051 A * 6/1956 Wassell ..... 108/103
2,820,533 A * 1/1958 Mount ..... 312/111
2,902,175 A * 9/1959 Shoffner ..... 108/103

(Continued)

FOREIGN PATENT DOCUMENTS

DE 3120932 A1 * 4/1982 ..... B42F 17/02

OTHER PUBLICATIONS

C3 Brandworks, Inc., http://c3brandworks.com/ongoing/silver-joes-coffee-co/ (downloaded Oct. 10, 2013), and cited by Trademark Examiner in a Final Action dated Oct. 10, 2013, in U.S. Trademark Application No. 85/803,221.

(Continued)

*Primary Examiner* — Joshua Rodden

(74) *Attorney, Agent, or Firm* — Meunier Carlin & Curfman, LLC

(57) ABSTRACT

The present disclosure is directed to an arrangement, a method of arranging, and a storage unit for product packages. The storage unit includes a shelving unit, a divider, and a display case. The arrangement includes product packages arranged around a central axis such that a side surface of the product package faces away from the central axis and a second product package is arranged around the central axis such that a spine surface of the second product package faces away from the central axis.

11 Claims, 21 Drawing Sheets

(56) References Cited

U.S. PATENT DOCUMENTS

| | | | | | |
|---|---|---|---|---|---|
| 2,951,593 | A | * | 9/1960 | Lake | 108/139 |
| 4,193,351 | A | * | 3/1980 | Belokin, Jr. | 108/59 |
| 4,345,526 | A | * | 8/1982 | Streit | 108/191 |
| 4,588,093 | A | * | 5/1986 | Field | 211/51 |
| 4,688,684 | A | * | 8/1987 | Young et al. | 211/59.4 |
| 4,700,850 | A | * | 10/1987 | Morgan et al. | 211/131.1 |
| 4,783,130 | A | * | 11/1988 | Twellmann | 312/193 |
| 5,423,425 | A | * | 6/1995 | Stompe | A47F 5/0068 206/449 |
| 5,524,775 | A | * | 6/1996 | Kaine | 211/131.1 |
| 6,189,710 | B1 | * | 2/2001 | Mason | 211/131.1 |
| 6,206,493 | B1 | * | 3/2001 | Sanchez-Levin et al. | 312/125 |
| 6,929,117 | B1 | * | 8/2005 | Cohen | 206/45.25 |
| 6,968,959 | B1 | * | 11/2005 | Garvin | 211/50 |
| 9,004,299 | B2 | * | 4/2015 | Hardin | A47B 49/004 211/131.1 |
| 2006/0059756 | A1 | * | 3/2006 | Wells | 40/654.01 |

OTHER PUBLICATIONS

Chicago Display Marketing Corporation, http://www.chicagodisplay.com/photo-gallery.html (downloaded Oct. 10, 2013), and cited by Trademark Examiner in a Final Action dated Oct. 10, 2013, in U.S. Trademark Application No. 85/803,221.

DDI Project Gallery, http://www.ddionline.com/displayand-designideas/galleries/apparel-specialty/Spanx-Shop-New-York-5662.htm (downloaded Mar. 18, 2013).

ebay, http://ebay.com/bhp/retail-display-tables (downloaded Oct. 10, 2013), and cited by Trademark Examiner in a Final Action dated Oct. 10, 2013, in U.S. Trademark Application No. 85/803,221.

Displays2Go, http://www.displays2go.com/C-27301/Retail-Show-Cases-Have-a-Frameless-Construction (downloaded Oct. 10, 2013), and cited by Trademark Examiner in a Final Action dated Oct. 10, 2013, in U.S. Trademark Application No. 85/803,221.

U.S. Trademark Application No. 85/803,221, filed Dec. 14, 2012, and the prosecution history thereof.

U.S. Trademark Application No. 85/803,223, filed Dec. 14, 2012, and the prosecution history thereof.

Design U.S. Appl. No. 29/465,880, filed Sep. 3, 2013, and the prosecution history thereof.

Shenzhen Leader Display Pdts Ltd., http://www.cardboard-display-stands.com/china-round_display_stands_pallet_display_box_for_supermarket_retail-1237727.html (downloaded Oct. 10, 2013), and cited by Trademark Examiner in a Final Action dated Oct. 10, 2013, in U.S. Trademark Application No. 85/803,221.

Vigilant Woodworks, http://vigilantinc.com/commercial/island-display-packages.php (downloaded Oct. 10, 2013), and cited by Trademark Examiner in a Final Action dated Oct. 10, 2013, in U.S. Trademark Application No. 85/803,221.

Wanzl, http://www.wanzl.com/en_DE/products/shelving-systems-and-installation-solutions/wire-tech.html (downloaded Oct. 10, 2013), and cited by Trademark Examiner in a Final Action dated Oct. 10, 2013, in U.S. Trademark Application No. 85/803,221.

* cited by examiner

PRODUCT STORAGE UNIT AND METHOD OF ARRANGEMENT

CROSS-REFERENCE TO RELATED APPLICATIONS

This application is a continuation-in-part of U.S. Design patent application Ser. No. 29/465,880, filed Sep. 3, 2013, and titled "Display Tower," the entire disclosure of which is hereby incorporated by reference.

FIELD OF THE DISCLOSURE

This disclosure generally relates to a product storage unit and display arrangement where the product packages are arranged around the central axis of the storage unit.

BACKGROUND

Retail stores frequently arrange product packages, for both storage and display, side-by-side along a flat/vertical display stand. This arrangement is used, for example, when arranging hosiery at department stores and displaying greeting cards at convenience stores. These traditional arrangement styles can be problematic in displaying clothing packages because a flat/vertical display stand can limit the customer's viewing angle/line of sight of the product. A customer may have to stand directly in front of/perpendicular to the flat display stand to have a direct view of the product packages. This flat/vertical arrangement can be, therefore, inefficient for displaying product to customers who may not pass directly in front of the display stand.

Additionally, when using a flat/vertical display stand the storage capacity of the display is limited. In retail stores, product packages are usually stored by placing packages in front of/behind one another. Accordingly, the storage capacity of the display stand is limited by its depth in proportion to the thickness of the product package. Often an important consideration in retail stores is the product-to-floor space ratio for a storage arrangement. Because this arrangement for storing product packages is dependent on the depth of the display stand, the product-to-floor space ratio is not always optimal. Accordingly, a need in the art exists for a display unit and storage arrangement that provides the customer with a direct line of sight of the product while maximizing product storage per area of floor space.

SUMMARY

Disclosed herein are systems and methods for arranging product packages. An aspect of the present disclosure is directed to a product display arrangement for a plurality of product packages. Each of the plurality of product packages may include two opposing side surfaces, a top surface and opposing bottom surface, and a front surface and opposing spine surface. The spine surface may have a larger surface area than the front surface. The side surfaces may have a surface area larger than a surface area of adjacent surfaces sharing an edge with each of the side surfaces. The arrangement may include a first product package arranged around a central axis such that a side surface of the first product package faces away from the central axis and is substantially parallel to the central axis. The arrangement may also include a second product package arranged around the central axis such that the spine surface of the second product package faces away from the central axis.

Another aspect of the present disclosure is directed to a method of arranging product packages. The method may include providing a plurality of product packages where each of the product packages has two opposing side surfaces, a top surface and opposing bottom surface, and a front surface and opposing spine surface. The spine surface may have a larger surface area than the front surface. The side surfaces may have a surface area larger than a surface area of adjacent surfaces sharing an edge with each of the side surfaces. The method additionally may include arranging a first product package around a central axis such that a side surface of the first product package faces away from and is substantially parallel to the central axis. The method may also include arranging a second product package around the central axis such that the spine surface of the second product package faces away from the central axis.

A further aspect of the present disclosure is directed to a storage unit. The storage unit may include a plurality of cylindrical shelving units. The cylindrical shelving units may be arranged vertically along a central vertex axis of the storage unit. Each of the cylindrical shelving units may include a top surface and opposing bottom surface and an outer surface defining the perimeter of both the top and bottom surface. The storage unit may also include a divider. The divider may extend between the top surface of a first shelving unit and the bottom surface of a second shelving unit. The divider may also extend in a radial direction away from the central axis. The divider may define a storage space sized and configured to receive a plurality of product packages. The storage unit may also include a display case. The display case may be coupled to at least one of the plurality of cylindrical shelving units. The display case may be configured to receive a product package such that a display surface of the product package faces away from the central axis.

The details of one or more implementations of the disclosure are set forth in the accompanying drawings and the description below. Other features, objects, and advantages of the disclosure will be apparent from the description and drawings, and from the claims.

DESCRIPTION OF THE DRAWINGS

The following detailed description will be better understood when read in conjunction with the appended drawings, in which there is shown one or more of the multiple embodiments of the present disclosure. It should be understood, however, that the various embodiments of the present disclosure are not limited to the precise arrangements and instrumentalities shown.

In the drawings, like reference symbols indicate like elements.

DETAILED DESCRIPTION

Figure 1A:
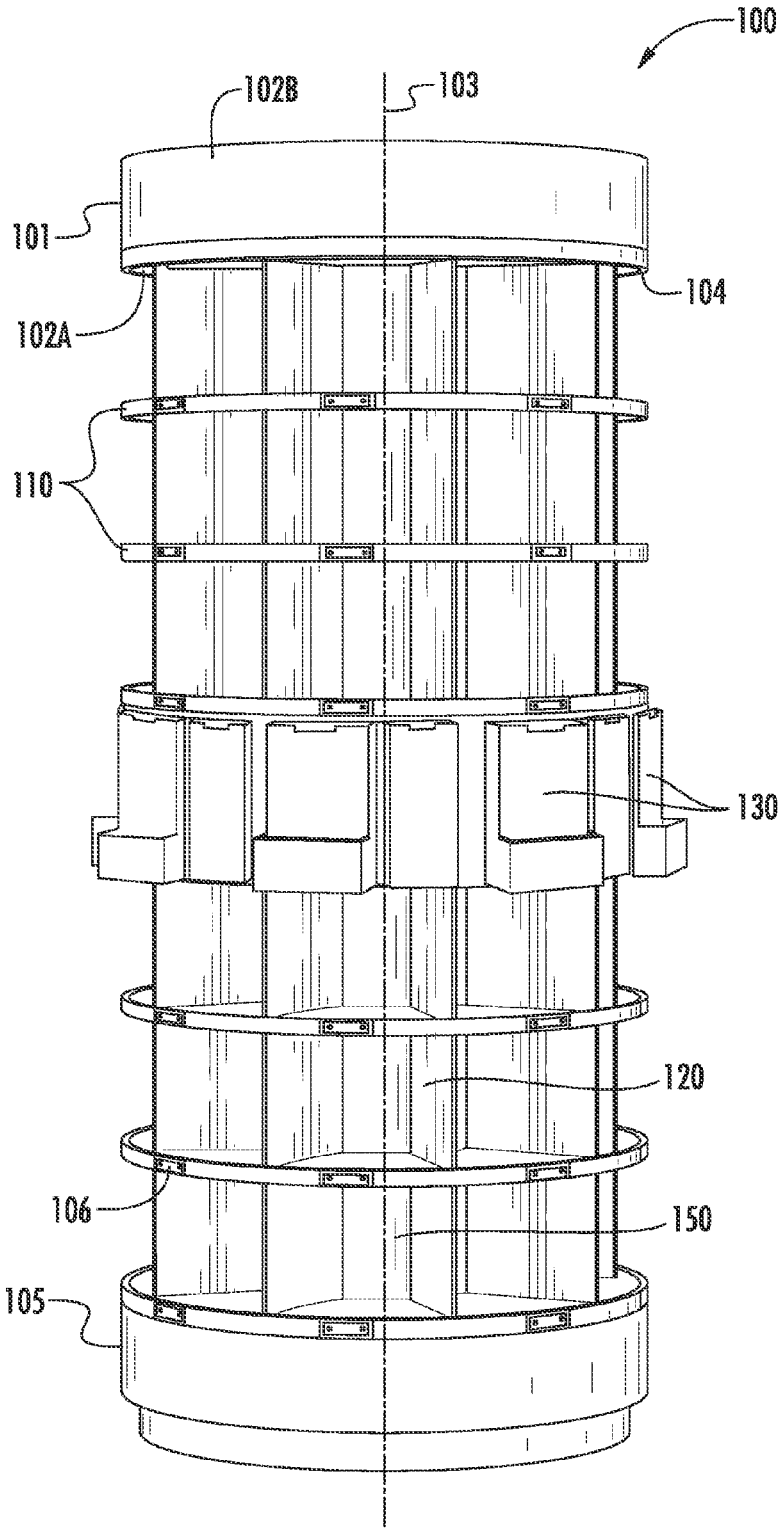
FIG. 1A is a perspective view of an example storage unit.

Certain terminology is used herein for convenience only and is not to be taken as a limitation on the present disclosure. In the drawings, the same reference numbers are employed for designating the same elements throughout the several figures. A number of examples are provided, nevertheless, it will be understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The directional terms "vertical and "horizontal" are used to describe components merely for the purposes of clarity and illustration and are not meant to be limiting. Also, the words "inner" and "outer" refer to directions toward and away from, respectively, the geometric center of the described feature or device. The term "coupling" or "coupled" refers to using adhesives, bolts, welds, clamps, screws, clips and any other fasteners as known in the art.

Certain exemplary implementations of the disclosure will now be described with reference to the drawings. In general, such implementations relate to systems and methods for arranging product packages to increase storage space and improve product display.

Figure 1B:
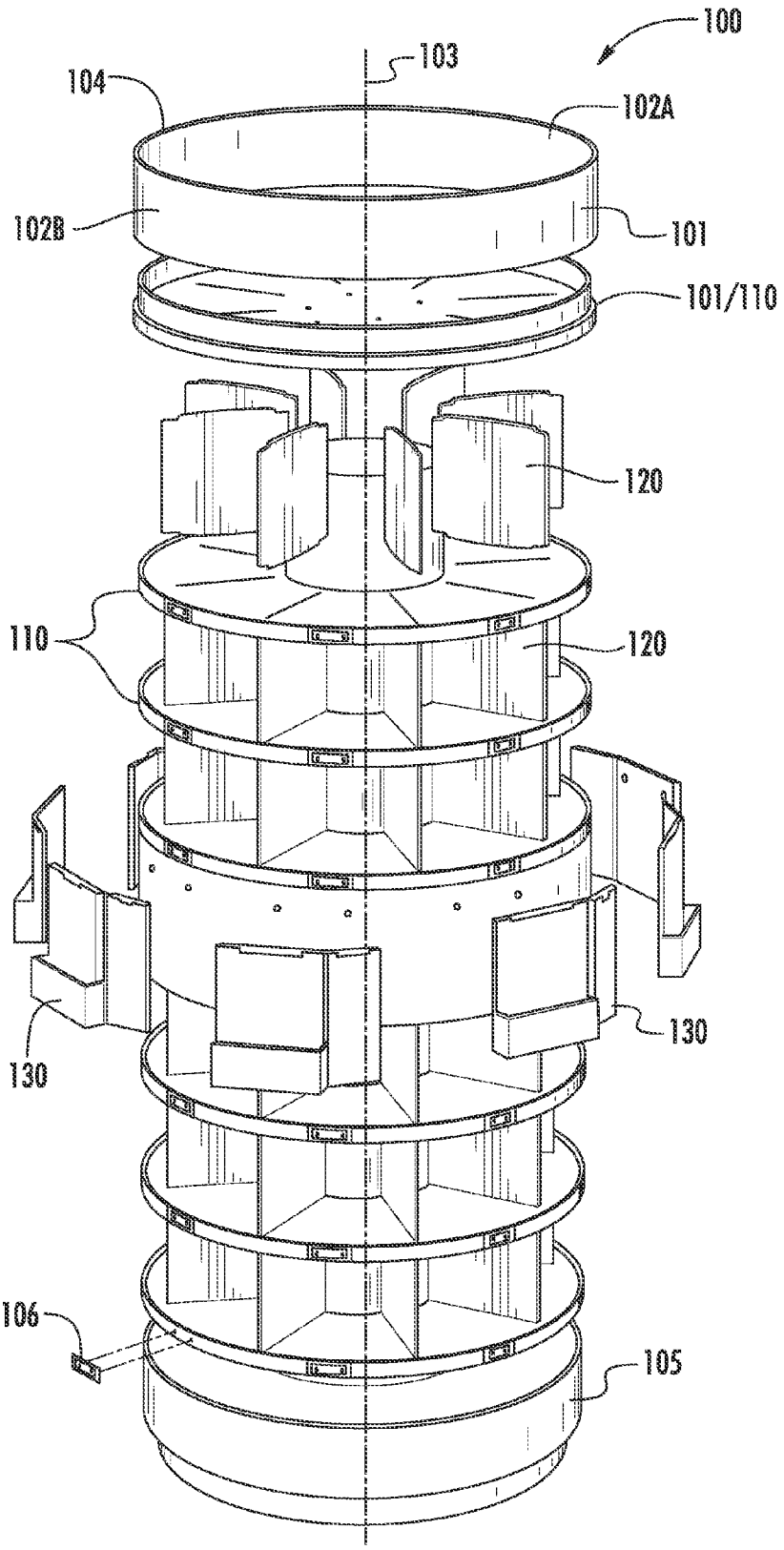
FIG. 1B is a partially exploded perspective view of the example storage unit of FIG. 1A.

Referring now to FIGS. 1A and 1B, an illustrated example of a storage unit 100 is provided. A storage unit 100 can be used to improve the display and storage of product packages 200 for a limited retail floor area. In one example, the storage unit 100 is used to display and store clothing product packages 200. As will be described in more detail below, an example storage unit 100 can include a shelving unit 110 and a divider 120 defining a storage space configured to receive product packages 200. An example storage unit 100 can also include a display case 130 coupled to an outer surface of the storage unit 100 (e.g., an outer surface of a shelving units 110). The display case 130 can be configured to receive and display a product package 200. The number of shelving units 110, dividers 120, and display cases 130 can vary depending on design choice.

The storage unit 100 can also include a top cap 101. The top cap 101 can be coupled to the uppermost shelving unit 110 and/or dividers 120 coupled to the uppermost shelving unit 110. For example, the top cap 101 can be permanently or releasably mounted, rested or coupled to the uppermost shelving unit 110 and/or dividers 120. The top cap 101 can be used to display advertisement, electronic signage, and other indicia. The top cap 101 can be of varying shapes, sizes, materials, and configurations. In one example, the top cap 101 can be in the shape of a hollow cylinder as illustrated in FIGS. 1A and 1B. This hollow cylinder example can include an inner vertical wall 102A, an outer vertical wall 102B, and a thickness/base 104 which separates the two walls 102A, 102B. The top cap 101 can be made of, for example, a solid continuous material or a corrugated material, leaving air pockets between the two vertical walls 102A, 102B. The top cap 101.

The example storage unit 100, illustrated in FIGS. 1A and 1B, can also include a base 105. The base 105 can provide structure and support for the storage unit 100. Generally, the base 105 is located at the bottom end of the storage unit 100 and shelving units 110 can be arranged vertically above the base 105. The base 105 can be coupled to the lowermost shelving unit 110 and/or dividers 120 coupled to the lowermost shelving unit 110. For example, the base 105 can be permanently or releasably mounted, rested or coupled to the lowermost shelving unit 110 and/or dividers 120 such that one surface of the base 105 contacts a shelving unit 110/dividers 120 and a second (opposing) surface of the base 105 contacts the ground or other support structure. The base 105 can be configured to define a variety of shapes, including a cylindrical shape as illustrated in the example storage unit 100 depicted in FIGS. 1A and 1B.

Figure 1C:
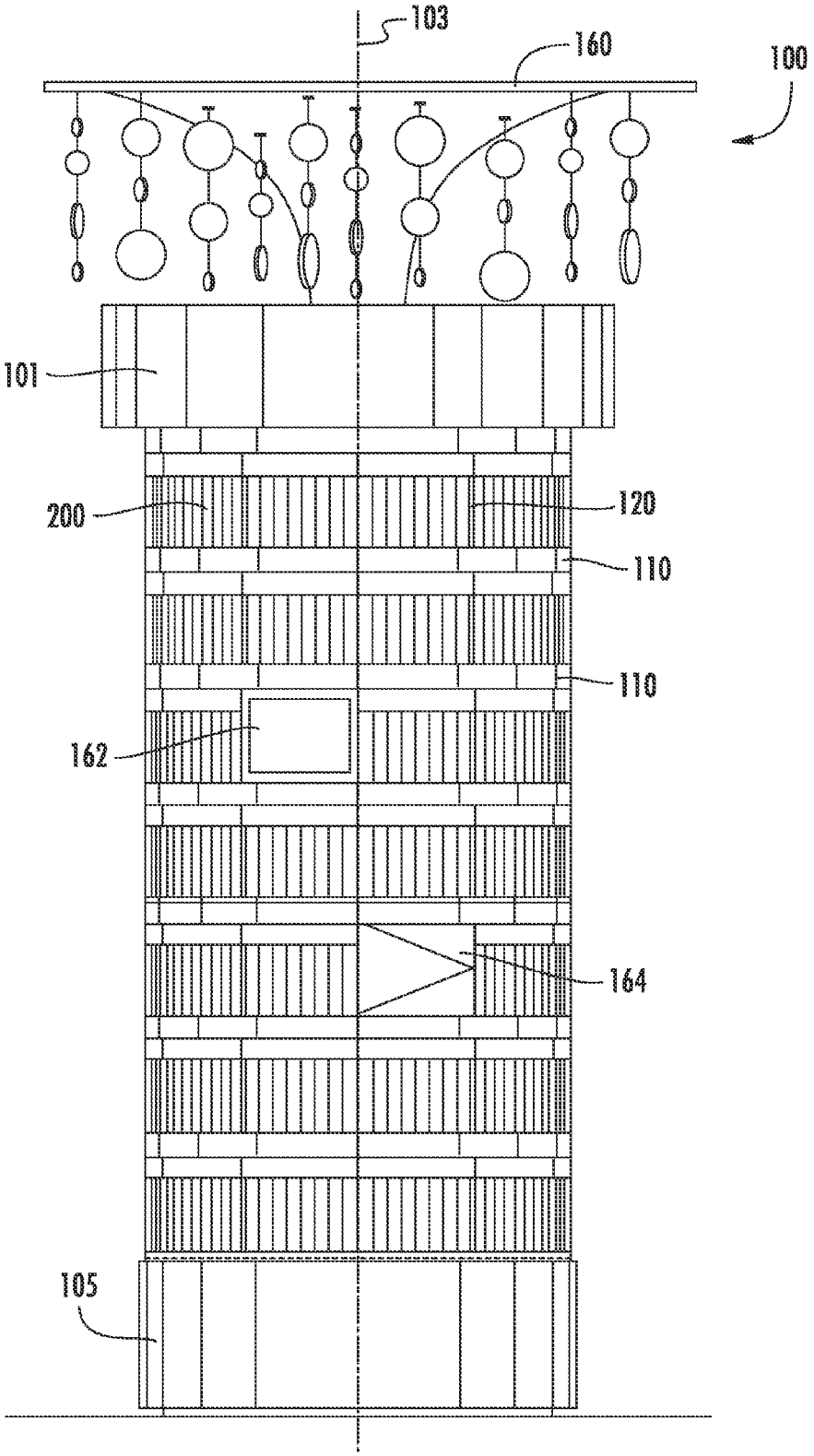
FIG. 1C is a front view of another example storage unit.
Figure 1D:
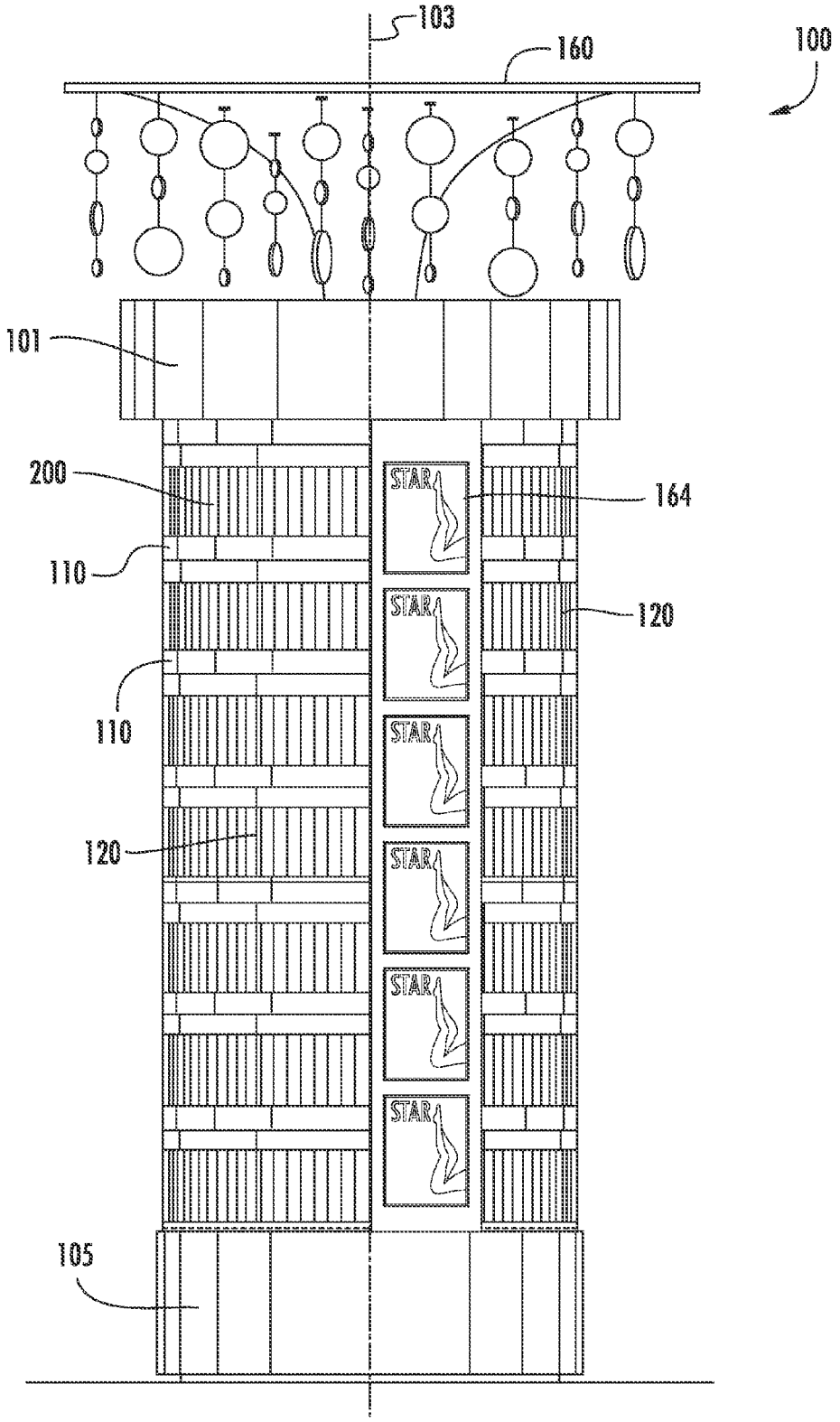
FIG. 1D is a front view of another example storage unit.
Figure 1G:
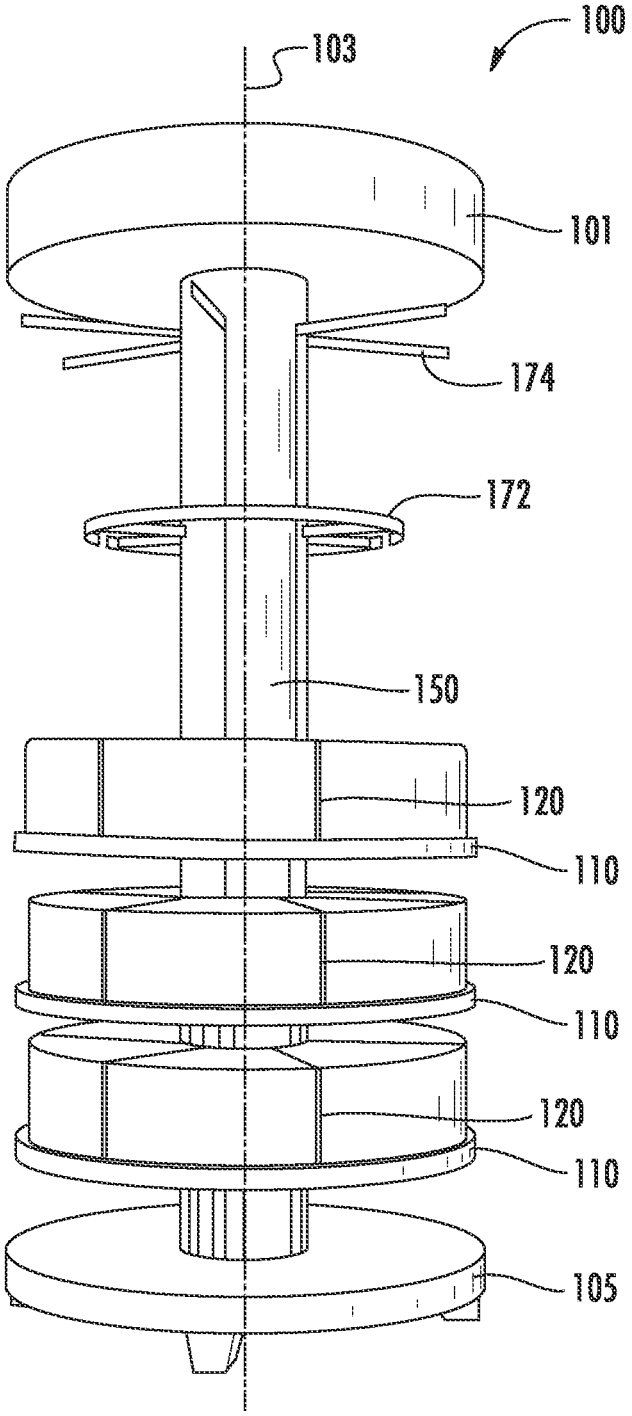
FIG. 1G is a perspective view of another example storage unit.
Figure 1H:
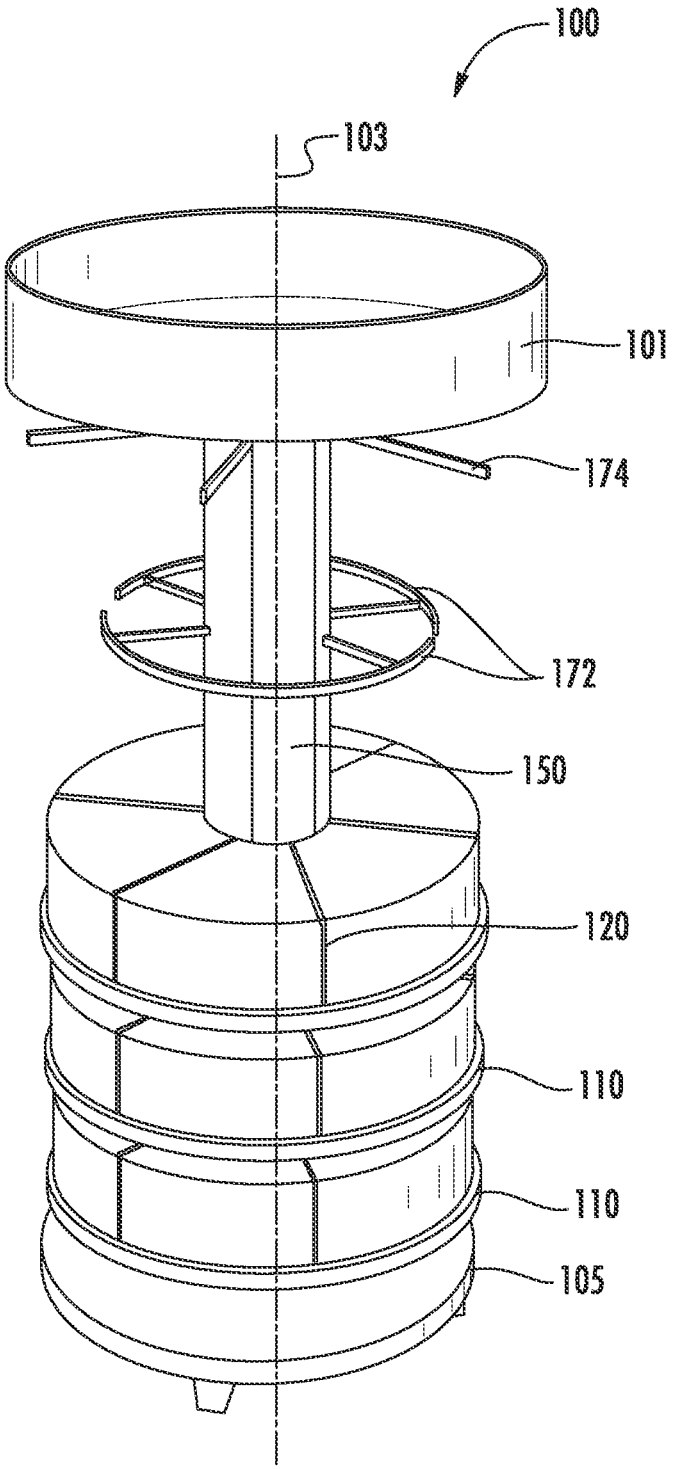
FIG. 1H is a perspective view of the example storage unit of FIG. 1G.
Figure 2A:
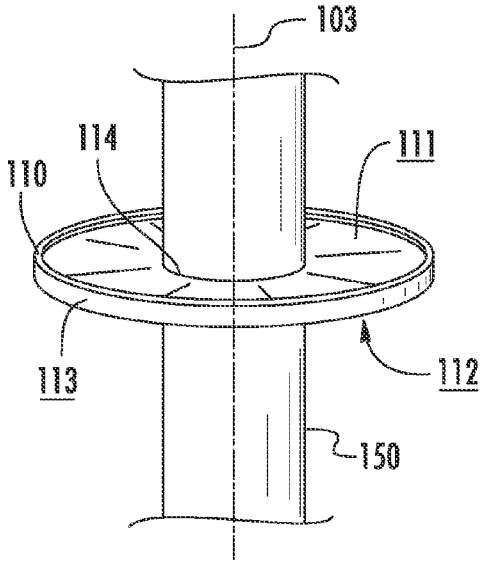
FIG. 2A is a partial perspective view of an example shelving unit and central post.
Figure 2B:
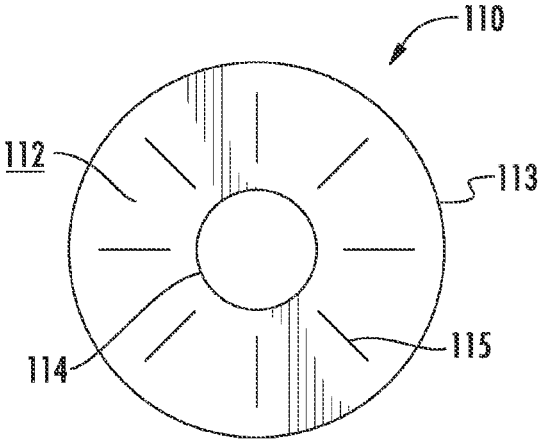
FIG. 2B is a bottom view of an example single shelving unit and central post.
Figure 2C:
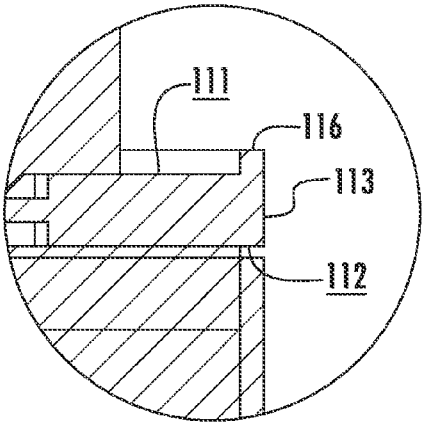
FIG. 2C is a partial cross-section view of an example shelving unit.

FIGS. 2A-2C provide illustrations of an example shelving unit 110. The storage unit 100 can include a plurality of shelving units 110 arranged vertically along the central axis 103 of the storage unit 100 (where the central axis 103 defines the geometric center of the storage unit 100). It is also contemplated that the storage unit 100 can include a single shelving unit 110 arranged vertically along the central axis 103 of the storage unit 100. An example shelving unit 110 can include several surfaces including, for example, a top surface 111, an opposing bottom surface 112, and an outer surface 113. The outer surface 113 can define the outer perimeter of the top and/or bottom surfaces 111, 112. The perimeter of the shelving unit 110 can define any regular or irregular shape including, for example, circular, elliptical, square, rectangular, or any other regular or irregular shape. In one example, illustrated in FIGS. 2A and 2B, the perimeter of the shelving unit 110 defines a circular shape thereby providing the shelving unit 110 a generally overall cylindrical shape. The top surface 111 and bottom surface 112 of the shelving unit 110 can define circular surfaces having generally equal surface areas. Likewise, the dimensions of the corresponding surfaces of each of the shelving units 110 can have the same or similar diameter, thickness, etc. In another example (not shown), the top surface 111 and the bottom surface 112 can define surfaces having different surface areas. While the shelving units 110 included the example storage unit 100 depicted in FIGS. 1A-1D, 1H and 1G are illustrated as having corresponding size and shape, it is contemplated that the size and shape of the individual shelving units 110 included in an example storage unit 100 can vary. For example, the storage unit 100 can include a plurality of shelving units 110 having different diameters, thicknesses, etc.

As illustrated in FIG. 2C, the shelving unit 110 can include a retaining edge 116. The retaining edge 116 can be used to secure product packages 200 within the shelving unit 110. For example, the retaining edge 116 can be located around the perimeter of the top surface 111. An example retaining edge 116 can extend from the top surface 111 of the shelving unit 110. For example, the retaining edge 116 can extend from the shelving unit 110 in a direction perpendicular to the top surface 111. The retaining edge 116 can prevent product packages 200 from accidentally or inadvertently falling out of the shelving unit 110, at least until the product packages 200 are lifted a sufficient distance so that the product packages 200 clear the retaining edge 116 and are removed from the storage unit 100. The distance between the central post 150 and the retaining edge 116 of the shelving unit 110 can be sized to accommodate the entire length of a product package 200.

Figure 3:
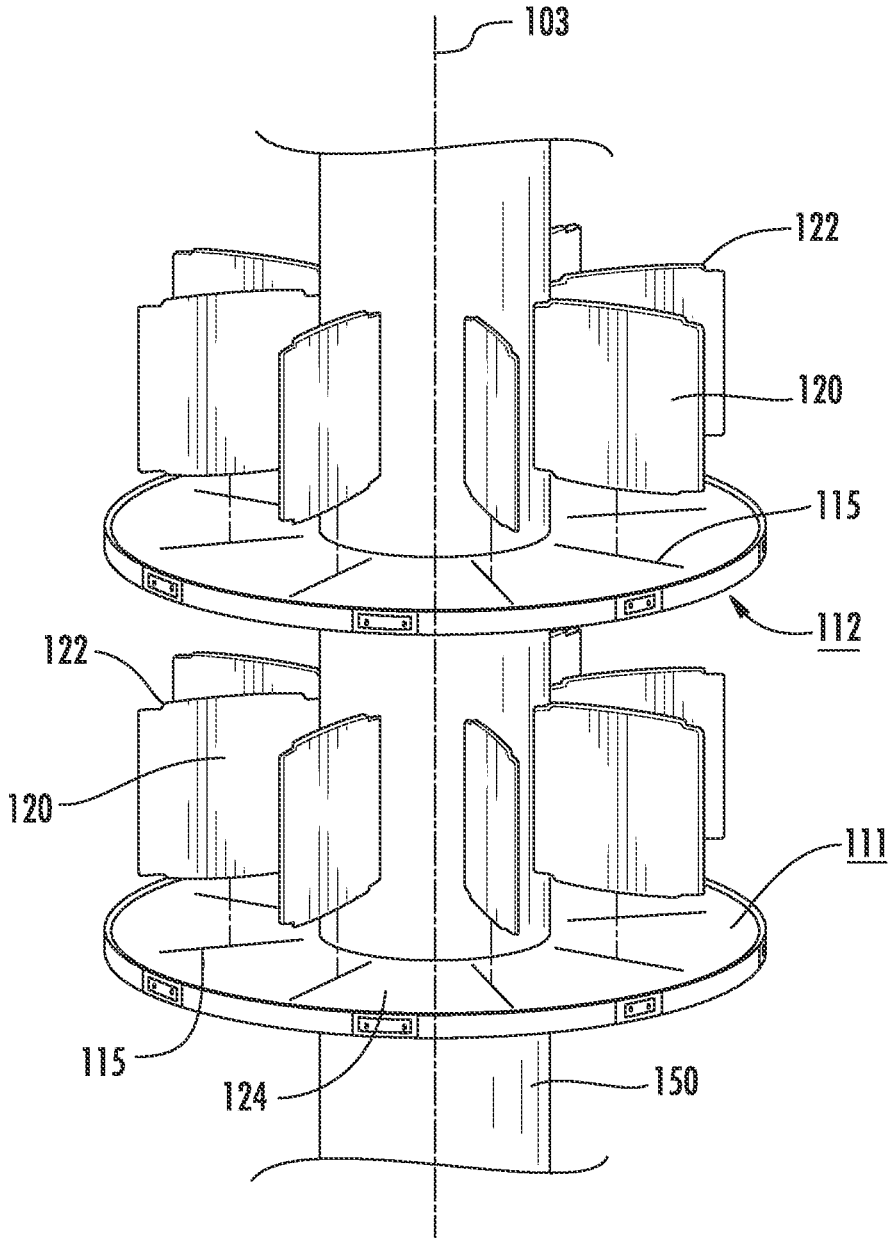
FIG. 3 is an exploded perspective view of example shelving units with dividers coupled to a central post.
Figure 4:
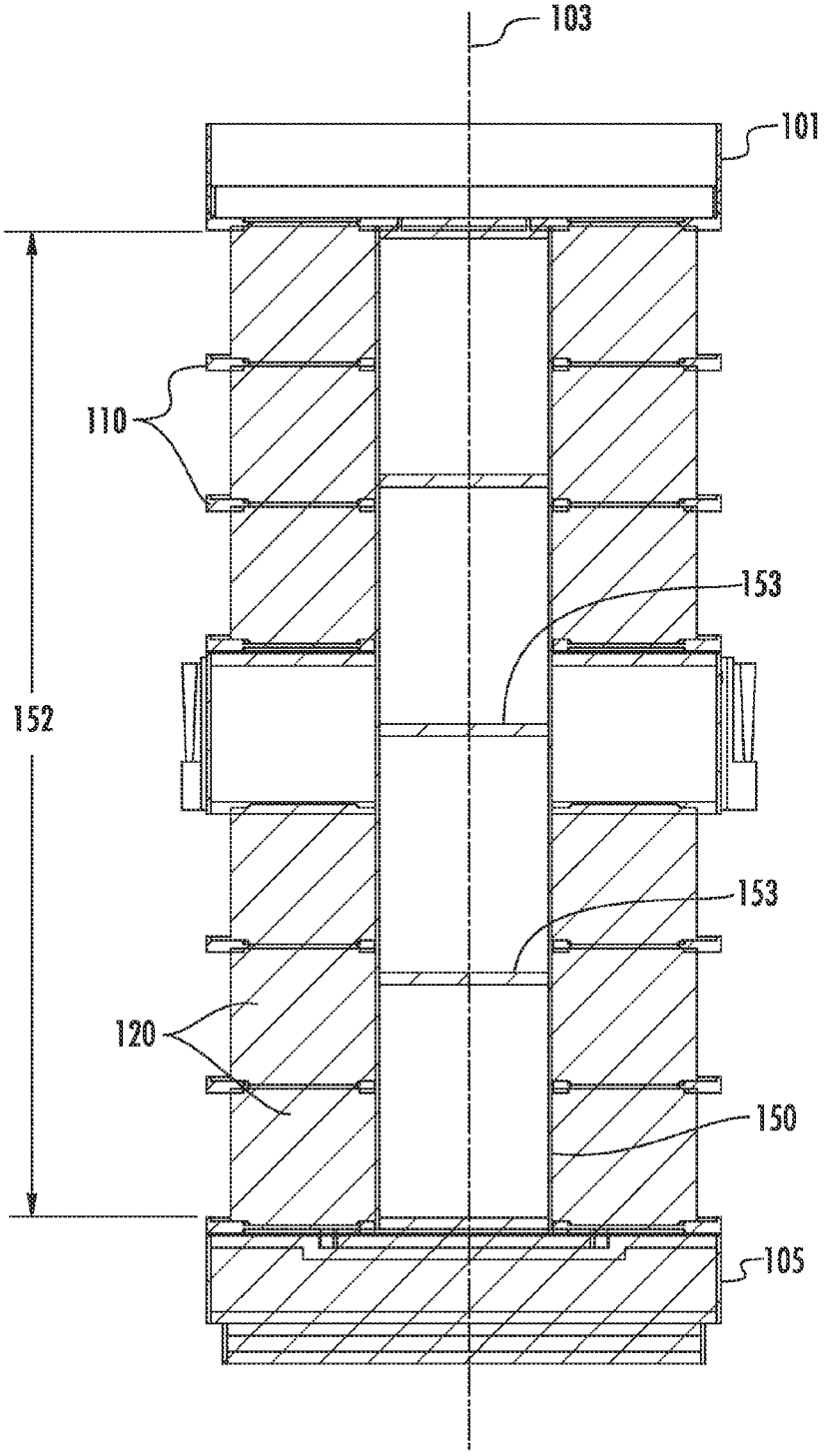
FIG. 4 is a front cross-sectional view of a an example storage unit.

As outlined above, the shelving units 110 can be arranged vertically along the central axis of the storage unit 100. In one example, the shelving units 110 are coupled to a central post 150 of the storage unit 100 where the central post 150 extends along the central (vertical) axis 103 of the storage unit 100. As illustrated in FIGS. 1A and 4, an example central post 150 can be coupled to the top cap 101 and/or base 105. In another example (not shown), the central post 150 can extend through and/or into the top cap 101 and/or the base 105. As provided in FIGS. 1, 2A, 3 and 4, the shelving units 110 can be stacked, mounted, coupled, positioned or otherwise arranged with respect to the central post 150 in a variety of ways. As illustrated in FIGS. 2A and 2B, the shelving units 110 can include an opening 114 sized and configured to abut and/or receive the central post 150. The opening 114 can be configured in the same variety of shapes as the central post 150. For example, as depicted in FIGS. 2A and 2B, the central post 150 can define a cylindrical shape and the opening 114 having a corresponding round shape. The opening 114 can extend through the shelving unit 110 from the top surface 111 through to the bottom surface 112 of the shelving unit 110. In another example (not show), the opening 114 does not extend through the top and/or bottom surface 111, 112 of the shelving unit 110. In one example, a shelving unit 110 can be placed along the central post 150 by sliding each individual shelving unit 110 along the length of the central post 150 to a connection point where the shelving unit 110 is coupled to the central post 150.

The central post 150 can define a solid, partially solid, or hollow structure. As illustrated in FIG. 4, the interior of the central post 150 can include a support beam 153 (or plurality of support beams 153) extending between the opposing internal walls of the central post 150. The support beam 153 can be used to reinforce the structure of the central post 150 and provide stability and rigidity to the storage unit 100.

As outlined above, the central post 150 can have a round/circular cross-section and thereby define a cylindrical or tubular shape. The central post 150 can define any other regular or irregular shaped cross-section including, for example, circular, elliptical, square, and/or rectangular. In an example storage unit 100, the cross-section area of the central post 150 can remain constant along the vertical length, height 152, of the central post 150. In another example (not shown), the cross-section of the central post 150 can vary along the vertical length (height 152) of the central post 150. The height 152 of the central post 150 can be varied to determine the overall height of the storage unit 100 (not including the height of the top cap 101 and/or base 105).

The central post 150 can also include support structure to prevent accidental or unintended movement of the storage unit 100. For example, the central post 150 can be weighted such that the center of gravity and/or mass of the storage unit 100 (with or without product packages) is lowered and/or centered to prevent unintentional movement/tipping of the unit 100. The central post 150 can be weighted such that the overall center of mass/gravity of the storage unit 100 moves towards the central axis 103 of the storage unit 100. In another example, the central post 150 can include anchoring elements to fix/mechanically couple the central post 150 to the base 105 and/or ground/support structure.

The central post 150 can comprise a single elongated element extending along the longitudinal axis 103 of the storage unit 100. In another example, the central post 150 can include a plurality of elongated segments coupled together along the longitudinal axis 103 of the storage unit 100.

Figure 5A:
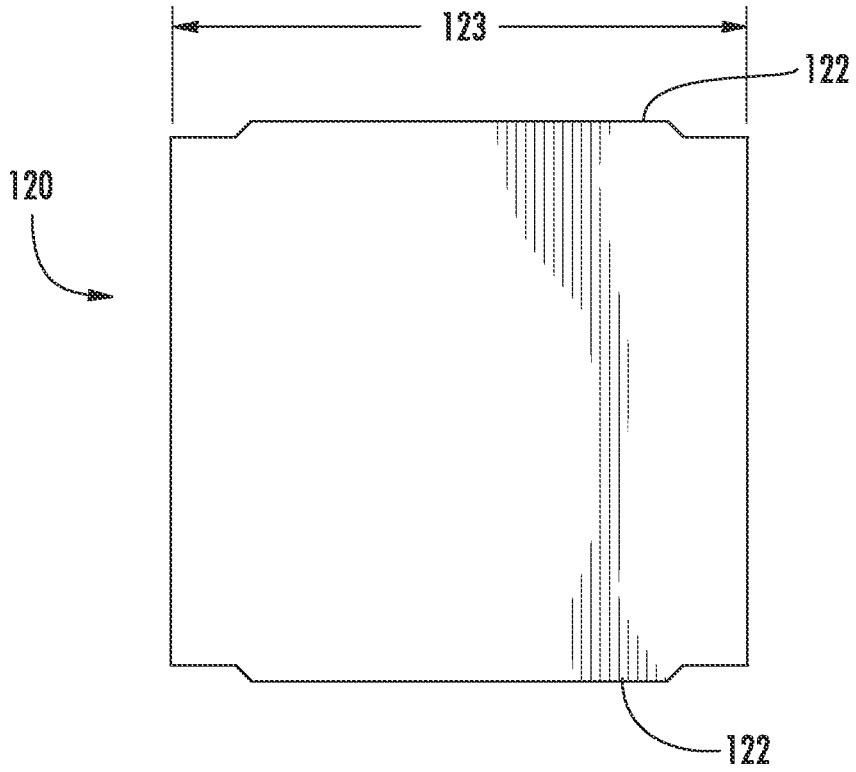
FIG. 5A is a front view of an example divider.
Figure 5B:
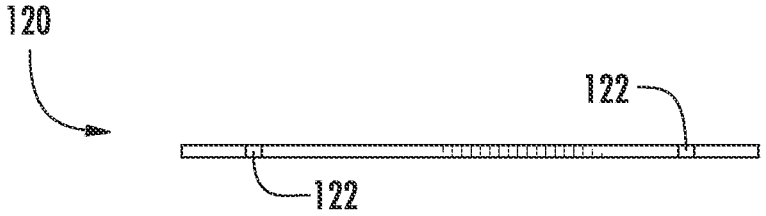
FIG. 5B is a top view of an example divider.

As outlined above, the storage unit 100 can include a divider 120. A divider 120 can be used to organize and store product packages 200 within the shelving unit 110. An example divider 120 is illustrated in FIGS. 5A and 5B. The divider 120 may extend between two shelving units 110. For example, the divider 120 can extend between the top surface 111 of a lower shelving unit 110 and the bottom surface 112 of an upper shelving unit 110. As illustrated in FIGS. 1B and 3, the divider 120 can extend in a radial direction away from the central axis 103 of the storage unit 100 and/or central post 150.

As illustrated in the figures, the number of dividers 120 used can vary. For example, a shelving unit 110 may include a single divider 120 or a plurality of dividers 120. It is contemplated that the number and position of the dividers 120 can be adjusted as needed to accommodate product package 200 placement on the shelving unit 110.

An example divider 120 can include multiple surfaces combined to define any regular or irregular shape including, for example, circular, elliptical, square, rectangular, or any other regular or irregular shape. As illustrated in FIGS. 5A and 5B, the divider 120 can define a rectangular shape. The divider 120 can include a coupling feature for mating with a corresponding coupling feature of the adjacent upper and/or lower shelving units 110. An example coupling feature can include protruding edges 122 extending from the top and bottom edges of the divider 120. The protruding edges 122 can be sized and configured to mate with corresponding slots 115 included on the shelving units 110. As illustrated in FIGS. 2A, 2B and 3, the slots 115 can extend radially along the top and/or bottom surfaces 111, 112 of the shelving unit 110. The slots 115 can include recesses extending partially into the shelving unit 110. In another example, the slots 115 can extend through the shelving unit 110. The protruding edges 122 of the divider 120 can be inserted into the slots 115 provided in the top and bottom surfaces 111, 112 of the adjacent shelving unit 110 to fix the position of the divider 120 within the storage unit 100.

Figure 6A:
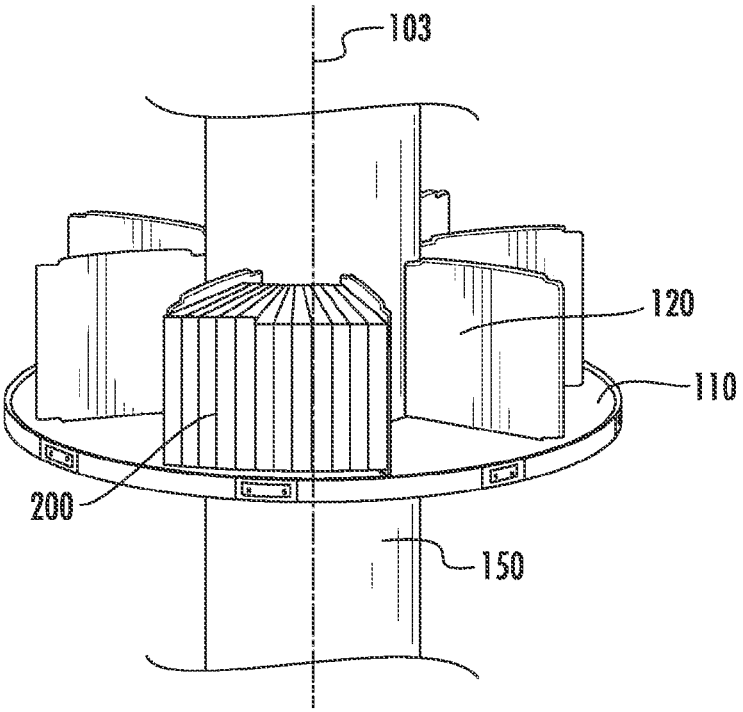
FIG. 6A is a partial perspective the example shelving unit of FIG. 3 including product packages.
Figure 6B:
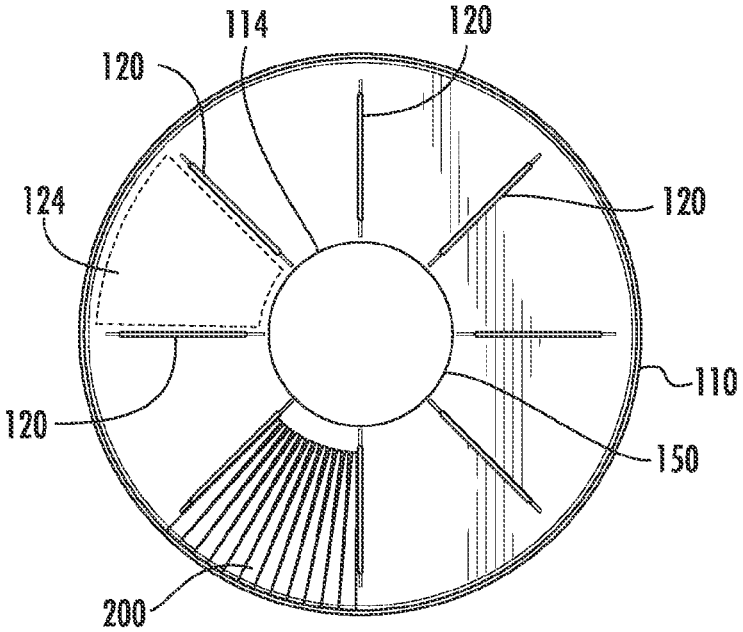
FIG. 6B is a top view the example shelving unit of FIG. 3 including product packages.

Coupled between adjacent shelving units 110, the divider 120 can be used to define a storage space 124 sized and configured to receive a product package 200 (and/or plurality of product packages 200). The storage space 124 can define a two-dimensional area that extends tangentially from a side surface of a divider 120 to another side surface of the same or adjacent divider 120. The storage space 124 can also define a three-dimensional space that extends between side surfaces of the divider 120 (and/or adjacent divider 120), a bottom surface 112 of an upper shelving unit 110 and a top surface 111 of a lower shelving unit 110. FIGS. 6A and 6B illustrate an example of a storage space 124 that spans between adjacent dividers 120. FIGS. 6A and 6B also illustrate example product packages 200 included in the storage space 124. As illustrated, the size and shape of the storage space 124 can correspond with the size and shape of the product package 200. For example, when the shelving unit 110 has circular shape and the dividers 120 extend radially from the central post 150, the resulting storage space 124 can define a wedge-shaped storage space 124. This wedge-shaped storage space 124 can be sized and configured to correspond to a generally-wedge shaped product package 200 (and the generally-wedge shape defined by the plurality of product packages included between adjacent dividers 120), as illustrated in FIG. 6B.

In another example storage unit 100, a storage space 124 for the product packages 200 can be defined by the area between the dividers 120 and the central post 150, as illustrated in FIG. 6B. Specifically, the storage space 124 can be defined as two-dimensional/three-dimensional space that extends tangentially between two adjacent dividers 120, the central post 150 and an edge of the shelving unit 110. For example, the storage space 124 can be defined as the space between a side surface of a first divider 120, a side surface of an adjacent second divider 120, an outer surface of the central post 150, and an edge (e.g., an inside edge of the retaining edge 116) of the shelving unit 110. The depth of the storage space 124 is defined between the outer surface of the central post 150 and the edge (e.g., the inside edge of the retaining edge 116) of the shelving unit 110. The depth of the storage space 124 can also be defined relative to the length 123 of the divider 120. It is contemplated that the depth of the storage space 124 is sized and configured to accommodate the length of a product package 200 positioned in the storage space 124. For example, the depth of the storage space 124 can be equal to or greater than the length of the product package 200.

In general, the storage space 124 can define a plurality of two and three-dimensional shapes with respect to the shelving unit 110 including, for example, a wedge shape, square shape, rectangular shape, and an unraveled cone shaped area. FIG. 6B illustrates an example wedge-shape storage space 124 on the shelving unit 110.

As outlined above, the storage unit 100 can include a display case 130. An example display case 130 is illustrated in FIGS. 7A-7F. The display case 130 can be coupled to an outer surface of the storage unit 100 (e.g., an outer surface of one of the shelving units 110) and be configured to receive and display a product package 200. An example display case 130 can include a compartment for holding and displaying product packages 200 in such a way that customers can view the display surface of a product package 200. The display case 130 can be coupled to the storage unit 100 using a hook, clip, screw, bolt, rivet, and/or any other form of mechanical connection/fastener known in the art.

Figure 7A:
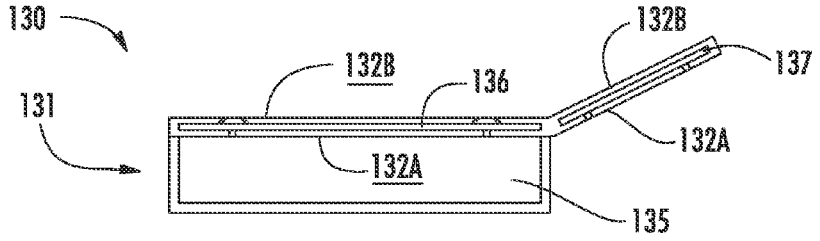
FIG. 7A is a top view of an example display case.
Figure 7B:
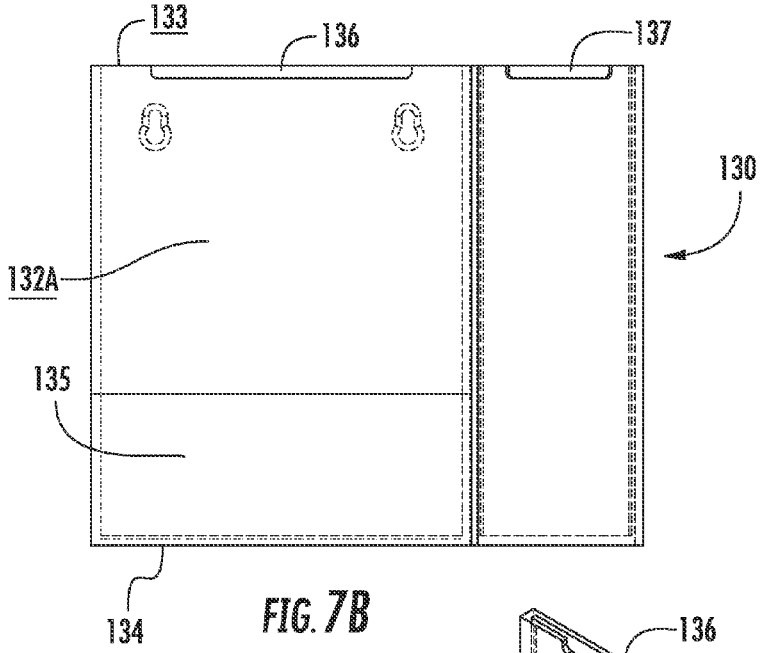
FIG. 7B is a front view of an example display case.
Figure 7C:
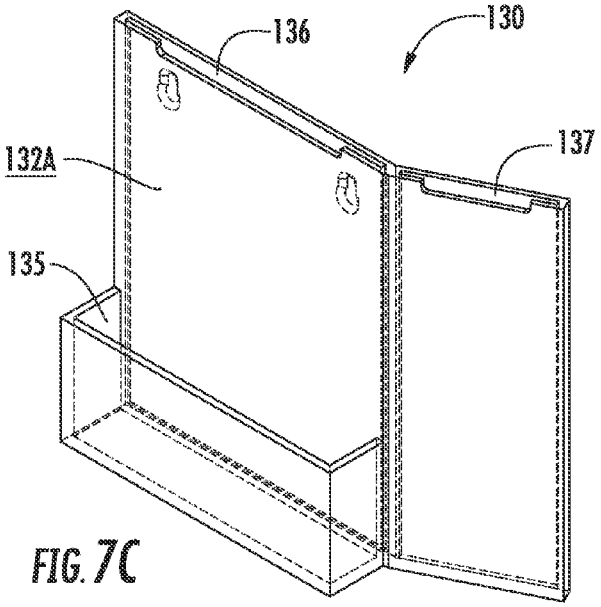
FIG. 7C is a perspective view of an example display case.
Figure 7D:
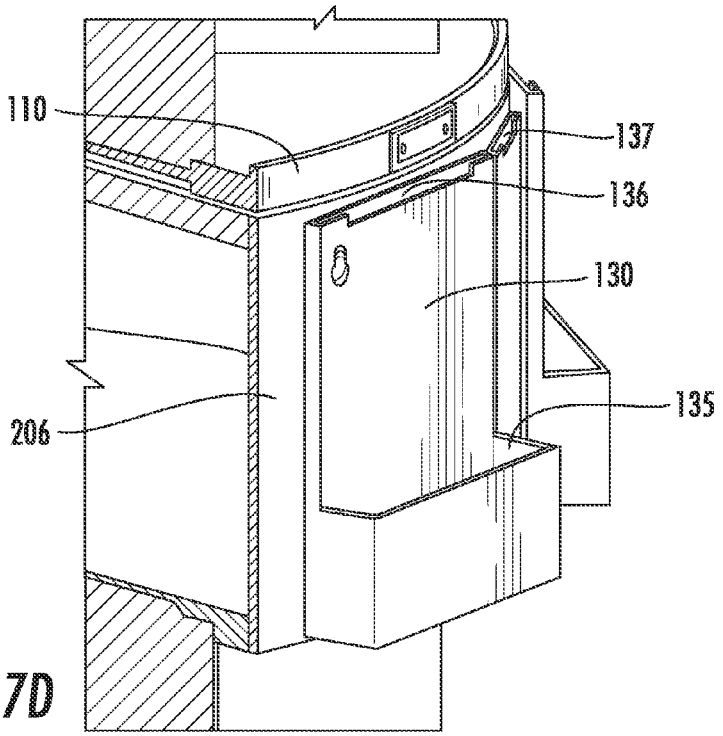
FIG. 7D is a perspective view of an display case coupled to a storage unit.
Figure 7E:
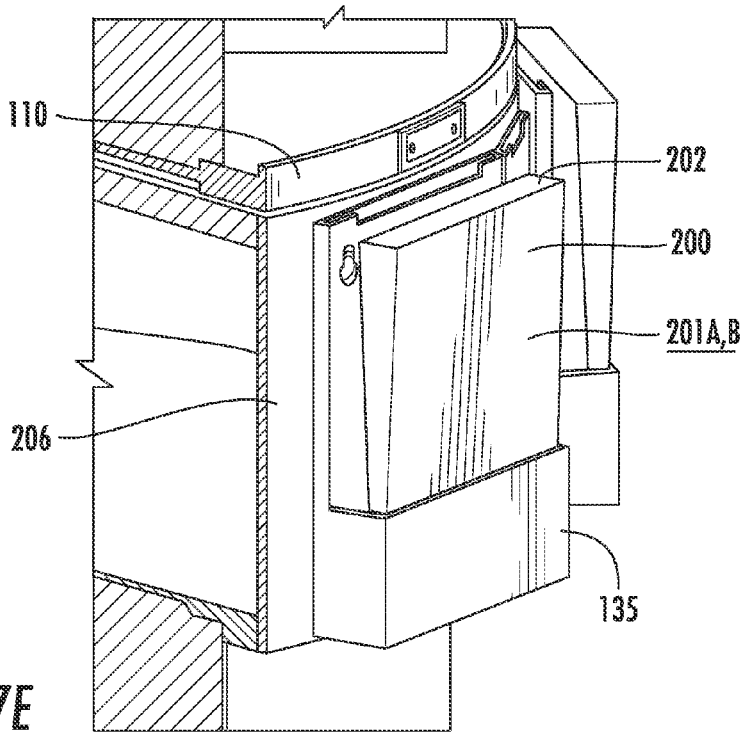
FIG. 7E is a perspective view of an example product package within the display case of FIG. 7D.
Figure 7F:
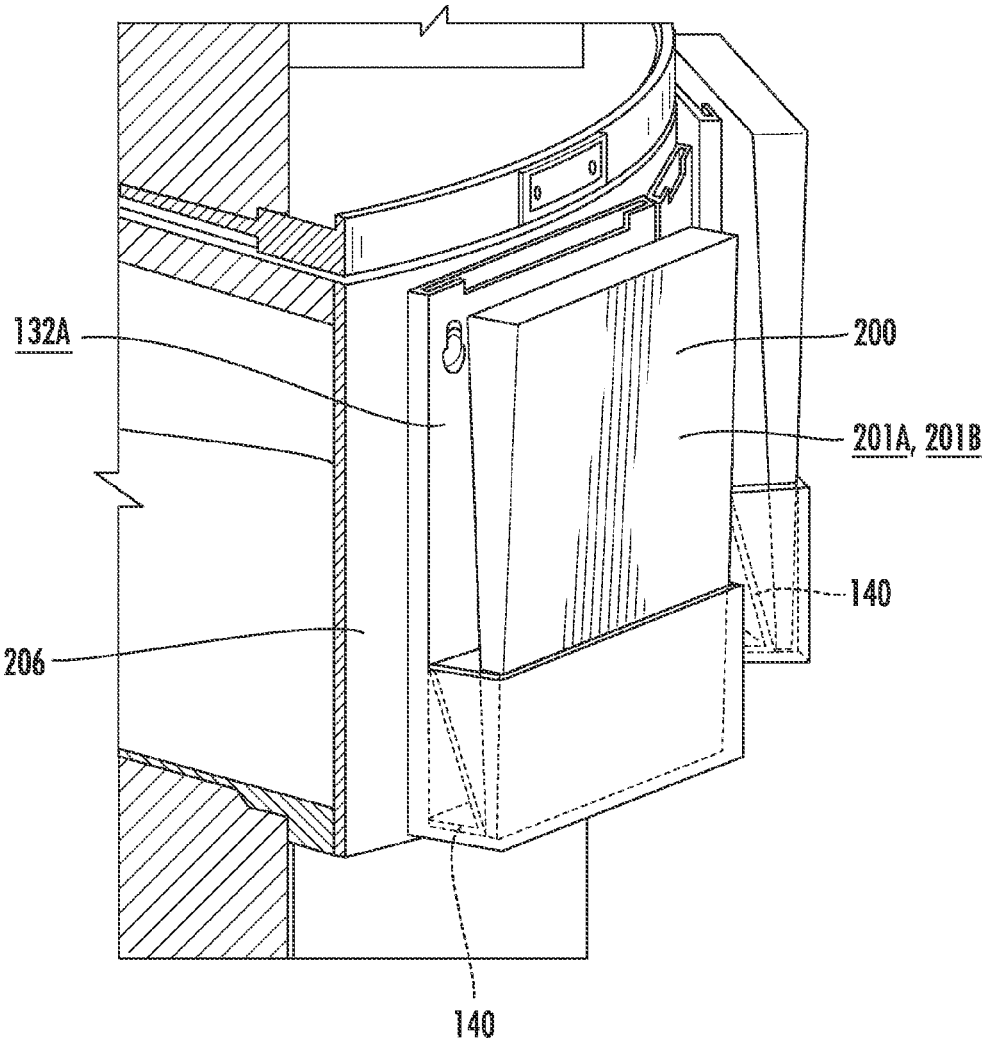
FIG. 7F is a perspective view of an example product package within the display case of FIG. 7D.

An example display case 130 can include a housing unit 131 comprising a front surface 132A, a back surface 132B, a top surface 133, and a bottom surface 134. The display case 130 can also include a compartment 135 extending away from the front surface 132A of the housing unit 131. An example compartment 135 can define a rectangular-shaped container. The compartment 135 can include a cavity sized and configured to receive a product package 200 such that a display surface 201A, 201B (as will be described in more detail below) of the product package 200 faces away from the central axis 103 of the storage unit 100. As illustrated in FIGS. 7E and 7F, a product package 200 can be placed in the compartment 135 with the display surface 201A or 201B facing away from the front surface 132A of the housing unit 131 and the vertical axis 103 of the storage unit 100.

The housing unit 131 can include a main pocket 136 defining a cavity between the front and back surfaces 132A, 132B. The main pocket 136 can extend along the height and width of the housing unit 131 and be sized and configured to receive informational material (e.g., printed product information) and/or other matter. The front and/or back surface 132A, 132B can also include notch-type openings positioned across a top surface 133 of the housing unit 131. The notch openings can allow for the insertion/removal of informational material or other matter from the main pocket 136.

In another example, the housing unit 131 can include a second pocket 137 located in an arm extending from the housing unit 131 adjacent to the main pocket 136. The arm/second pocket 137 can be located on the same plane as the back surface 132B of the housing unit 131 or can be placed at an angle from the plane of the back surface 132B/main pocket 136, as illustrated in FIG. 7A. The second pocket 137 can extend along the height and width of the arm and be sized and configured to receive informational material (e.g., printed product information) and/or other matter. The second pocket 137 can include notch-type openings similar to those included in the main pocket 136 positions across a top surface of the arm.

The display case 130 can be coupled directly or indirectly to the storage unit 100. For example, the display case 130 can be coupled directly to the outer surface of one or more shelving units 110. In another example, the display case 130 is coupled via an intermediate material/coupling feature 206 to the outer surface of the storage unit 100. An example coupling feature 206 can include a thin cylindrical ring attached to the outer surface of the storage unit 110 and/or shelving unit 110.

Figure 8:
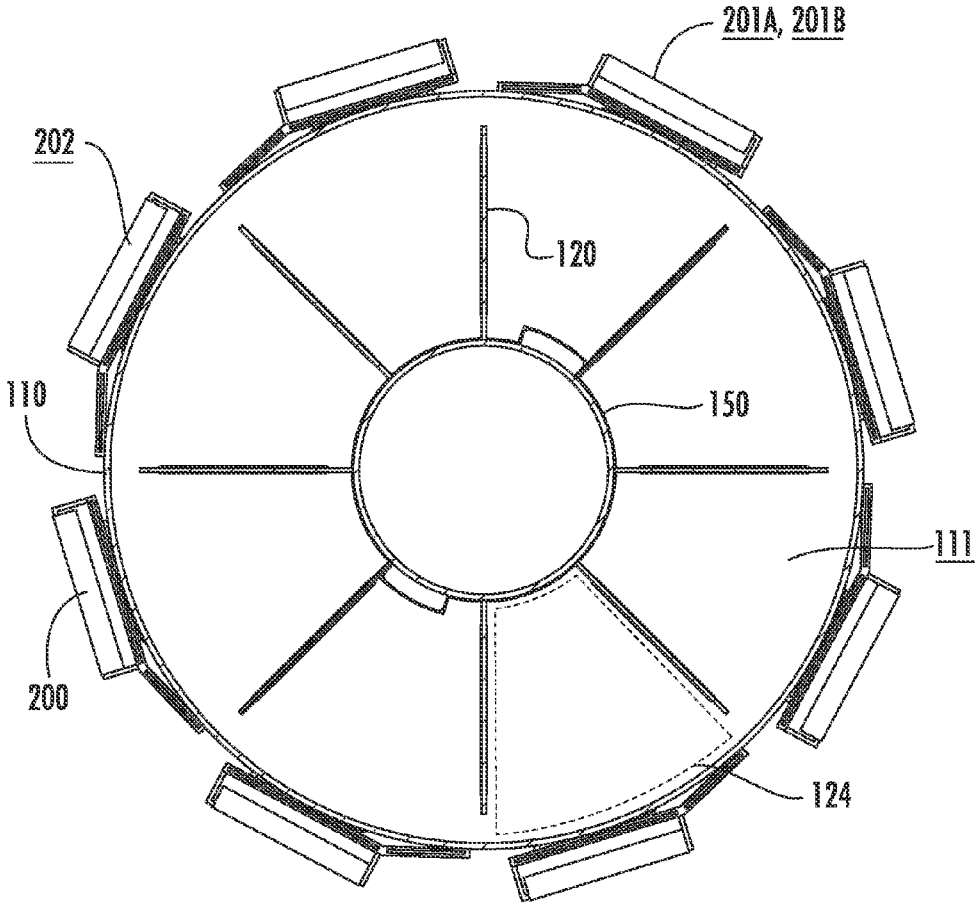
FIG. 8 is a top view of an example shelving unit with display cases attached.
Figure 9A:
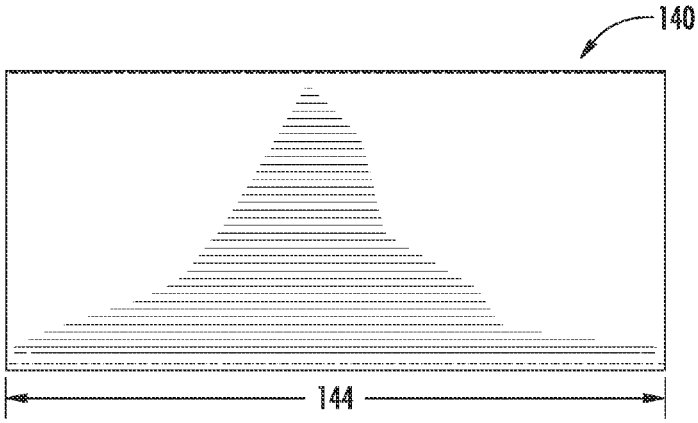
FIG. 9A is a front view of an example display case insert.
Figure 9B:
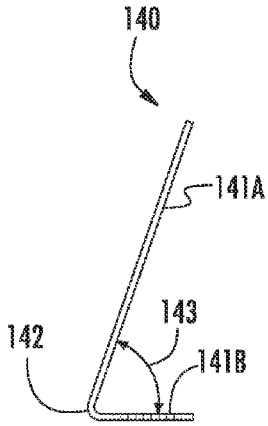
FIG. 9B is a side view of an example display case insert.
Figure 9C:
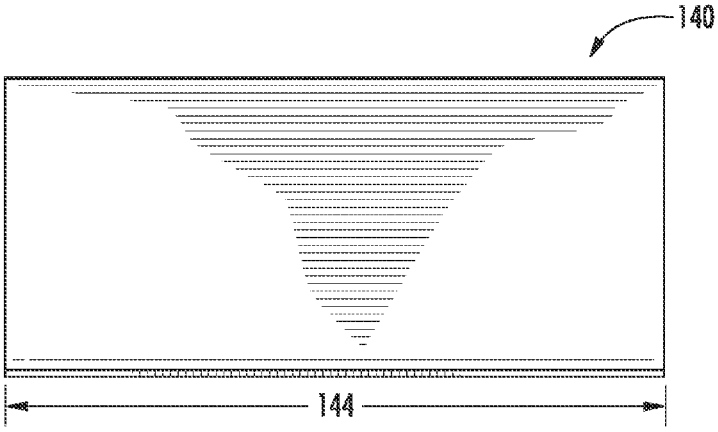
FIG. 9C is a back view of an example display case insert.
Figure 9D:
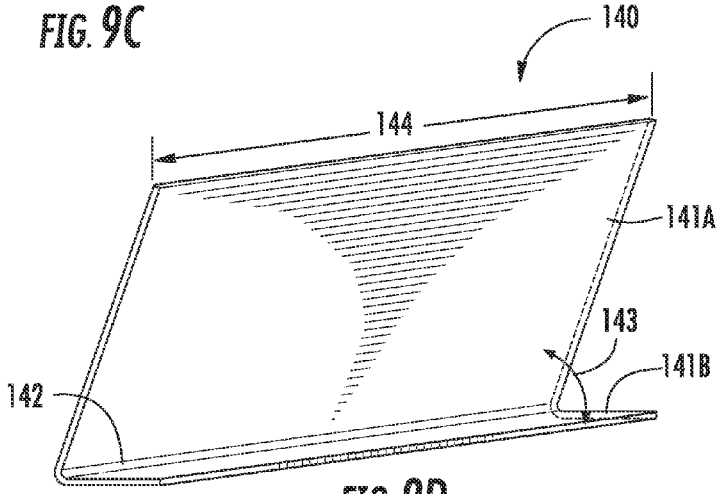
FIG. 9D is a perspective view of an example display.
Figure 10A:
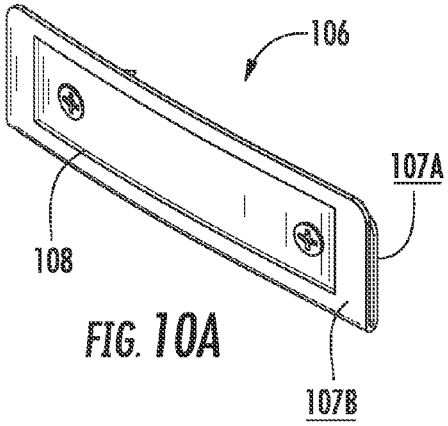
FIG. 10A is a front perspective view of an example display tab.
Figure 10B:
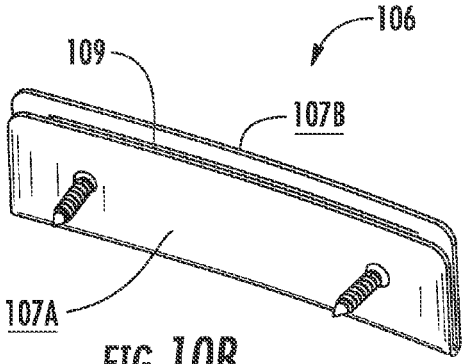
FIG. 10B is a back perspective view of an example display tab.
Figure 10C:
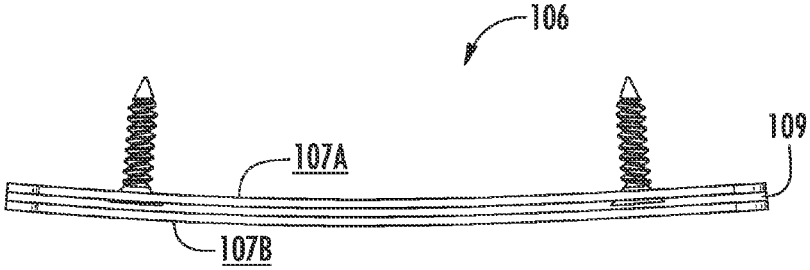
FIG. 10C is a top view of an example display tab.
Figure 10D:
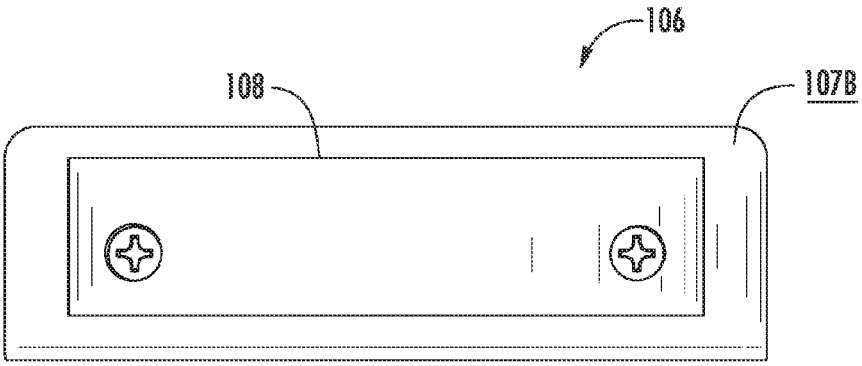
FIG. 10D is a front view of an example display tab.

As illustrated in FIGS. 1A and 1B, the display cases 130 can be coupled at regularly spaced intervals and/or patterns around the storage unit 100. For example, as illustrated in FIG. 8, the display cases 130 can be located around the circumference of the storage unit 100 at regularly spaced intervals. The display case 130 can be located at any position vertically along the storage unit 100. For example, as illustrated in FIGS. 1A and 1B, the display cases 130 can be located proximate the midsection of the storage unit 100. The display cases 130 can be located at other positions on the storage unit 100 including, for example, at or proximate the top cap 101 and/or the base 105. In another example, the display cases 130 are spaced/located randomly or at irregularly spaced intervals on the storage unit 100.

The storage unit 100 can also include an insert 140 used in conjunction with the display case 130. An example insert 140 is illustrated in FIGS. 9A-D. The insert 140 can be placed within the compartment 135 of the display case 130 to provide additional support to a product package 200 located within the compartment 135. The insert 140 can be sized and configured releasably fit within the compartment. For example, the insert 140 can have a length 144 equal to or less than the width of the compartment 135. Likewise, the insert 140 can have a depth equal to or less than the depth of the compartment 135.

The insert 140 can be used to direct the display surface 201A or 201B of the package 200 in such a way that the display surface 201A, 201B is viewable to a consumer (e.g., the display surface 201A, 201B faces away from the central axis of the storage unit 100). The insert 140 can include a first arm 141A and a second arm 141B joined at an edge 142. The first arm 141A and the second arm 141B extend away from each other creating an interior angle 143 between the arms 141A, 141B. The interior angle 143 can vary such that the display surface 201A, 201B of a product package 200 received within the compartment 135 is viewable to a consumer. For example, the interior angle 143 can be determined such that the display surface 201A, 201B/product package 200 is urged in a position substantially parallel to the central axis 103 of the storage unit 100. In one example, a display surface 201A, 201B is considered substantially parallel to the central axis 103 if the display surface 201A, 201B, when viewed by casual inspection, resembles a parallel surface from at least three feet away. In another example, the display surface 201A, 201B can be considered substantially parallel to the central axis 103 if the angle between the two is equal to or less than 45-degrees. In another example, the display surface 201A, 201B can be considered substantially parallel to the central axis 103 if the angle between the two is equal to or less than 30-degrees. In a further example, the display surface 201A, 201B can be considered substantially parallel to the central axis 103 if the angle between the two is equal to or less than 15-degrees. In another example, the display surface 201A, 201B can be considered substantially parallel to the central axis 103 if the angle between the two is equal to or less 10-degrees. In yet another example, the display surface 201A, 201B can be considered substantially parallel to the central axis 103 if the angle between the two is equal to or less than 5-degrees. In another example, the display surface 201A, 201B can be considered substantially parallel to the central axis 103 if the angle between the two is equal to or less than 2-degrees.

Additional example storage units 100 are depicted in FIGS. 1C and 1D. The storage unit 100 can include lighting fixtures 160, electronic signage 162, and/or artwork/advertisements 164 or other display/marketing-type fixtures. These features can be coupled to the storage unit 100 at, for example, a shelving unit 110, a divider 120, the display case 130, the top cap 101, and/or the base 105. The example lighting fixture 160 is depicted as coupled to the top cap 101, however a lighting fixture 160 can be coupled at any portion (and in any quantity) along the storage unit 100. Similarly, the electronic signage 162 is depicted as coupled along the midsection of the storage unit 100, however, electronic signage 162 can be coupled at any portion (and in any quantity) along the storage unit 100. The electronic signage 162 can include any active or passive electronic graphic user interface. Example electronic signage 162 includes a display screen, a touch screen, a personal data assistant (PDA), a telephone, and/or an internet personal access device/tablet. The artwork/advertisements 164 are depicted as coupled along the midsection of the storage unit 100 (FIG. 1C) and in a vertical column extending along the length of the storage unit 100 (FIG. 1D), however the artwork/advertisements 164 can be coupled at any portion (and in any quantity) along the storage unit 100.

Figure 1E:
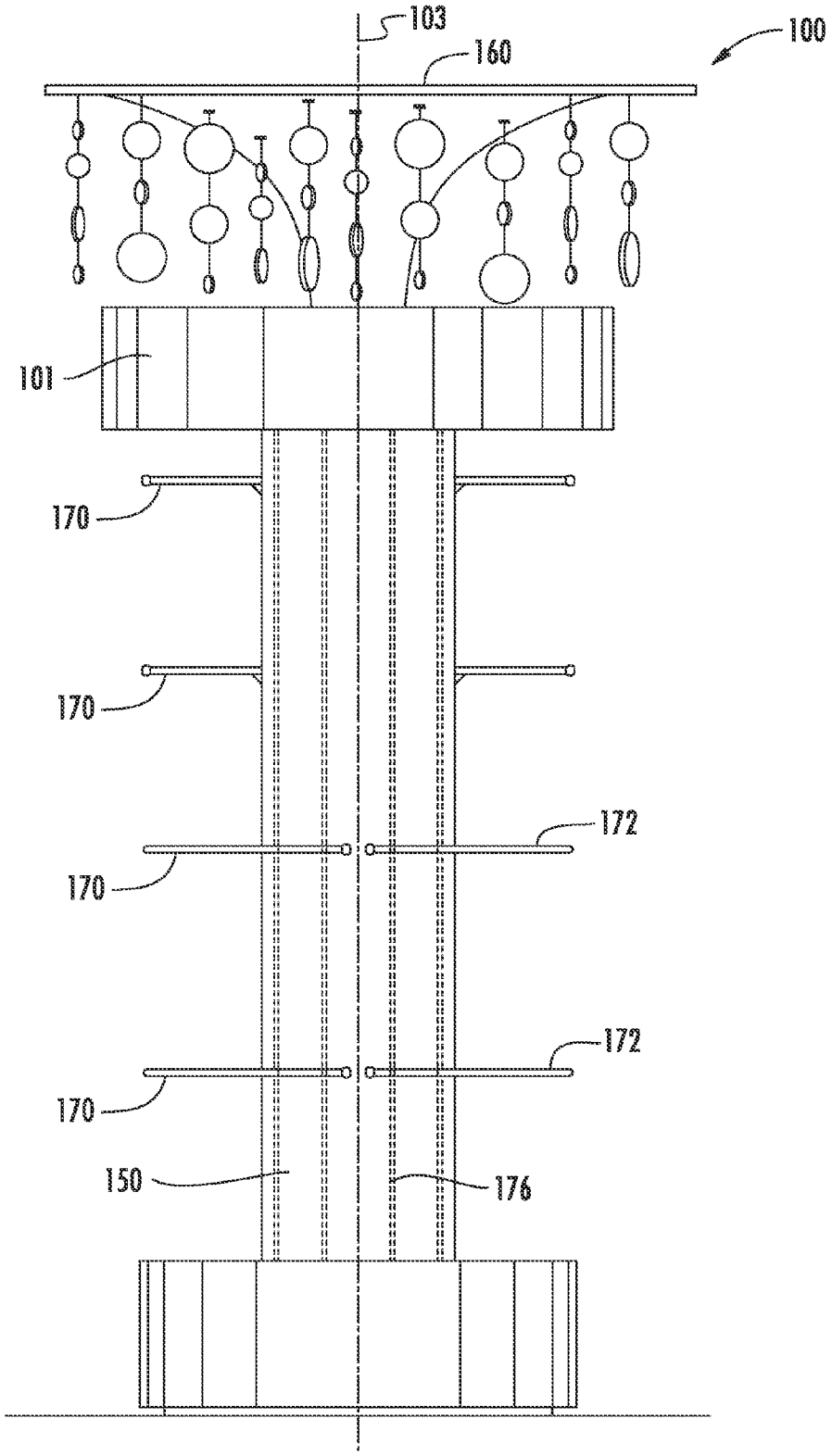
FIG. 1E is a front view of another example storage unit.
Figure 1F:
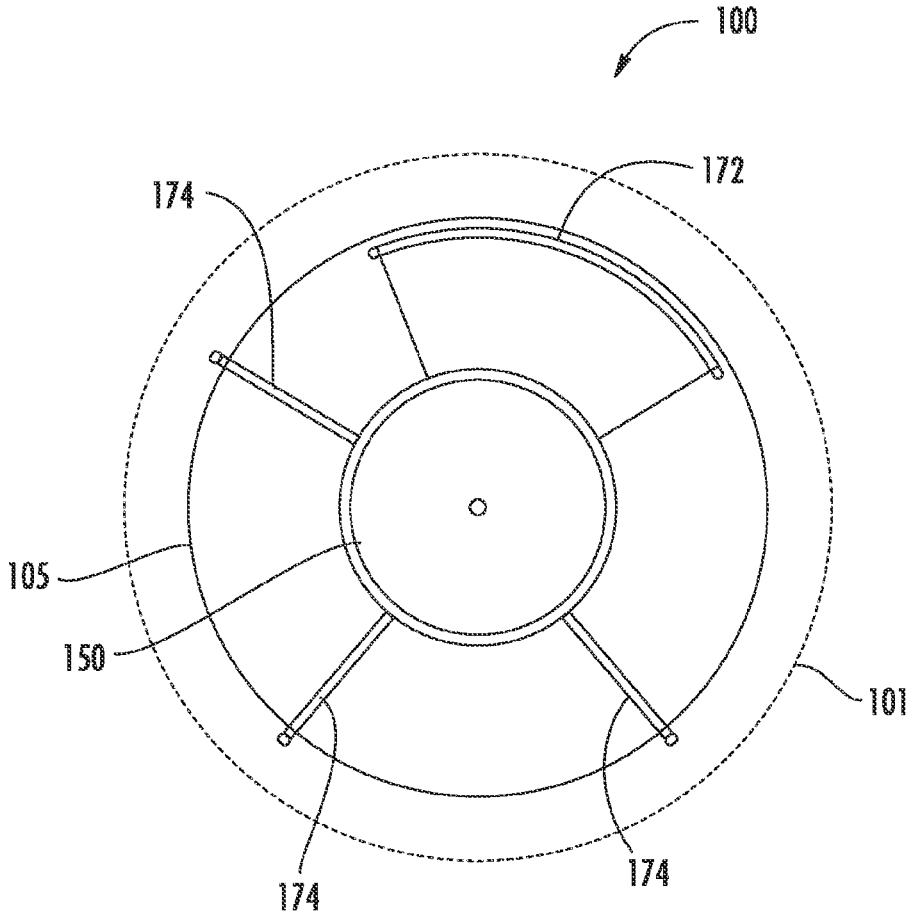
FIG. 1F is a top view of the example storage unit of FIG. 1E.

Another example storage unit 100 is illustrated in FIGS. 1E and 1F. The storage unit 100 includes components similar to those described with respect to storage unit of FIGS. 1A-1D. For example, the storage unit 100 includes a top cap 101, a base 105 and a central post 150 extending therebetween. The storage unit 100 provides for a the display and storage of merchandise, however, instead of including shelving units 110, the storage unit 100 includes a plurality of hang bars 170 arranged vertically along the central axis 103 of the storage unit 100. The hang bars 170 can extend from the central post 150 and provide a support for product being displayed on the storage unit 100. For example, the hang bars 170 can provide support surface for products attached to hangers or hooks. The hang bar 170 can include a round-style bar (round bar 172) extending in a circular trajectory around the central post 150. The round bar 172 can provide support for side hung product. As illustrated in FIG. 1F, providing a top view of the example storage unit 100, the round bar 172 can extend around a quarter of the circumference of the storage unit 100. However, it is contemplated that that the storage unit 100 can include a round bar 172 extending around any portion of the circumference of the storage unit 100. The hang bar 170 can also include a straight-style bar (straight bar 174) extending in a direction away from the central post 150. The straight bar 174 can provide support for a front facing (face out) hung product. As illustrated in FIG. 1E, the straight bar 174 extend perpendicular to the central post 150. In another example, the straight bar 174 can extend at an angle (positive or negative) from the central (vertical) axis 103 of the central post 150. Similarly, the straight bar 174 can extend radially from the central post 150, as illustrated in FIG. 1F. In another example, the straight bar 174 can extend at an angle radially from the central post 150. The hang bars 170 can be coupled at regularly spaced intervals and/or patterns around the storage unit 100. In another example, the hang bars 170 can be spaced/located randomly or at irregularly spaced intervals on the storage unit 100. The hang bars 170 can be permanently and/or removably coupled to the central post 150. The hang bar 170 can be coupled to the central post 150 using a hook, clip, screw, bolt, rivet, and/or any other form of mechanical connection/fastener known in the art. As illustrated in FIG. 1E, the hang bar 170 can be coupled to a recessed "T" standard-type connection 176 included on the central post 150.

Another example storage unit 100 is depicted in FIGS. 1G and 1H. The example storage unit 100 can include a combination of shelving units 110 arranged vertically along the central axis 103 of the storage unit 100 and hang bars 170 coupled to the central post 150 of the storage unit 100. For example, the storage unit 100 can include shelving units 110 located at a lower portion of the storage unit 100, a round bar 172 hang bar arranged vertically above the shelving units 110 along the central axis 103, and a straight bar 174 hang bar arranged vertically above the round bar 172. While the example storage unit depicted in FIGS. 1G and 1H includes three shelving units 110, two half circle round bars 172, and four straight bars 174, it is contemplated that the number and location of the shelving units 110 and hang bars 170 coupled to the storage unit 100 can vary.

The storage unit 100 can further include a display tab 106 used in conjunction with a shelving unit 110. An example display tab 106 is illustrated in FIGS. 10A-D. In one example, the display tab 106 can be configured to display relevant information to the customer. Information provided to the customer can include, for example, sizing information corresponding to particular product packages 200 situated proximate (e.g., below or above) the location of the display tab 106. As illustrated in FIGS. 10A-D, an example display tab 106 can comprise of an inner surface 107A and outer surface 107B that can be coupled to each other, creating a small cavity 109 between the two surfaces 107A, 107B. The outer surface 107B can also contain a window 108 providing access to the contents within the cavity 109. In the example display tab 106 depicted in FIGS. 10A-D, the inner surface 107A and outer surfaces 107B can have curved surfaces designed to correspond with the outer surface of the shelving unit 110. In one example, the display tab 106 can be made of a flexible material such that the inner surface 107A of the display tab 106 approximates the outer surface 113 of the shelving unit 110. The display tab 106 can be coupled to the storage unit 100 using a hook, clip, screw, bolt, rivet, and/or any other form of mechanical connection/fastener known in the art. As illustrated in FIGS. 10A-D, the display tab 106 include screws for coupling the with the storage unit 100. It is contemplated that the storage unit 100 may rotate (as a whole or as individual components, e.g., individual shelving units 110/groups of shelving units 110, top cap 101, etc.) with respect to the ground. For example, the base 105 can provide structure permitting the storage unit 100 (in its entirety) to be rotated relative to the ground. In another example, the base 105 can remain fixed while various other storage unit 100 components (e.g., shelving units 110, central post 150, top cap 101, etc.) rotate with respect to the base 105.

The storage unit 100 can also include support structure to prevent accidental or unintended movement of the unit whether or not loaded with product. For example, the base 105 can include weights that lower the center of gravity of the storage unit 100 and prevent accidental movement/tipping of the unit 100. In another example, the base 105 can include anchoring elements to fix/mechanically couple the base 105/storage unit 100 to the ground/support structure.

Figure 11A:
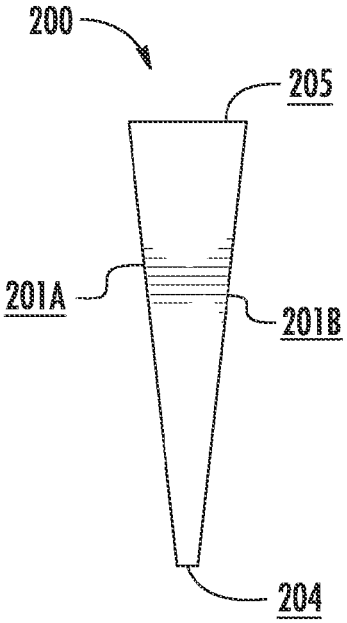
FIG. 11A is a side view of an example product package.
Figure 11B:
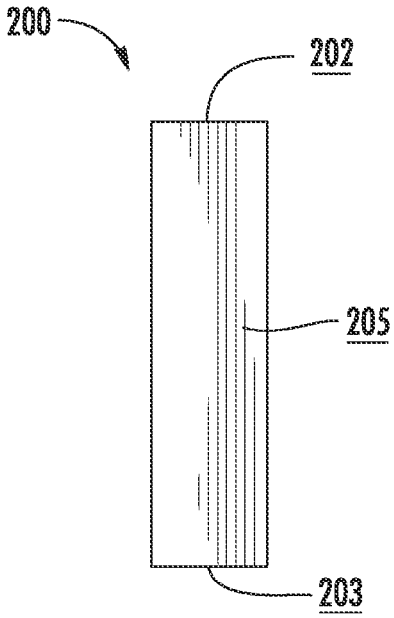
FIG. 11B is a top view of an example product package.
Figure 11C:
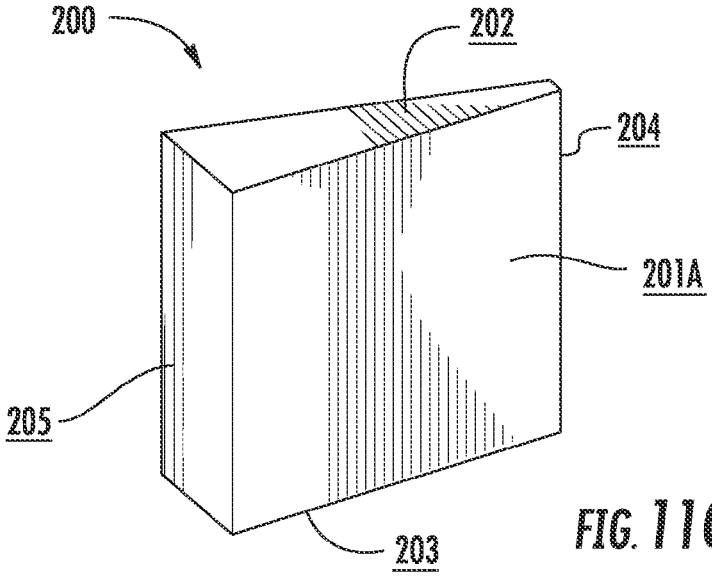
FIG. 11C is a perspective view of an example product package.

As outlined above, the storage unit 100 can be used for the storage and display of product packages 200. FIGS. 11A-C provide an example product package 200 that can be used in conjunction with the storage unit 100 or arrangement described herein. The product packages 200 can contain clothing products including, for example, garments, undergarments, compression garments, shapewear, hosiery, tights, socks, camisoles, undershirts, tanks, and active wear.

An example product package 200 can be provided in a variety of shapes and comprise a number of surfaces. For example, the product package 200 can define a hexagonal-shaped package, a rectangular or cube-shaped package, or any other regular or irregular shaped product package. In one example, illustrated in FIGS. 11A-C, the product packages 200 can define a wedge-shaped package. The wedge-shaped package can include gusseted or non-gusseted sides.

As illustrated in FIGS. 11A-C, an example wedge-shaped product package 200 can include two opposing side surfaces 201A, 201B, a top surface 202 and opposing bottom surface 203, and a front surface 204 and opposing spine surface 205. In the example product package 200, the spine surface 205 of the product packages 200 can have a larger surface area than that of the front surface 204. In another example, the side surfaces 201A, 201B can have a surface area larger than a surface area of adjacent surface sharing an edge with each of the side surfaces 201A, 201B (e.g., top surface 202, bottom surface 203, front surface 204, and spine surface 205). In another example, the two opposing side surfaces 201A, 201B can have the same surface area, while in another embodiment, the two opposing side surfaces 201A, 201B can have different surfaces areas.

At least one surface of the product package 200 can be designated as the display surface of the package 200. In general at least one of the side surfaces 201A, 201B are defined as the display surface of the product package 200. The display surface can define the largest surface area of the package 200. The display side can be used to provide information regarding the contents of the package to a customer. When the two opposing side surfaces 201A, 201B have the same area, either of the two surfaces can be the display surface.

Using a storage unit 100 as described above, or any suitable storage unit, product packages 200 can be arranged, in accordance with the present disclosure, in a variety of ways. In one example, illustrated in FIG. 12, product packages 200 can be arranged around a central axis 103 such that the spine surfaces 205 of various product packages 200 face away from the central axis 103. As illustrated, product packages 200 are arranged such that the side surfaces 201A, 201B of the product packages 200 can be located adjacent to each other. In the example arrangement, the side surfaces product packages 200 can be arranged with side surfaces 201A, 201B touching each other. By arranging product packages 200 around a central axis 103 as described, the product-to-floor space ratio can improved when compared to a traditional flat display stand.

Figure 12:
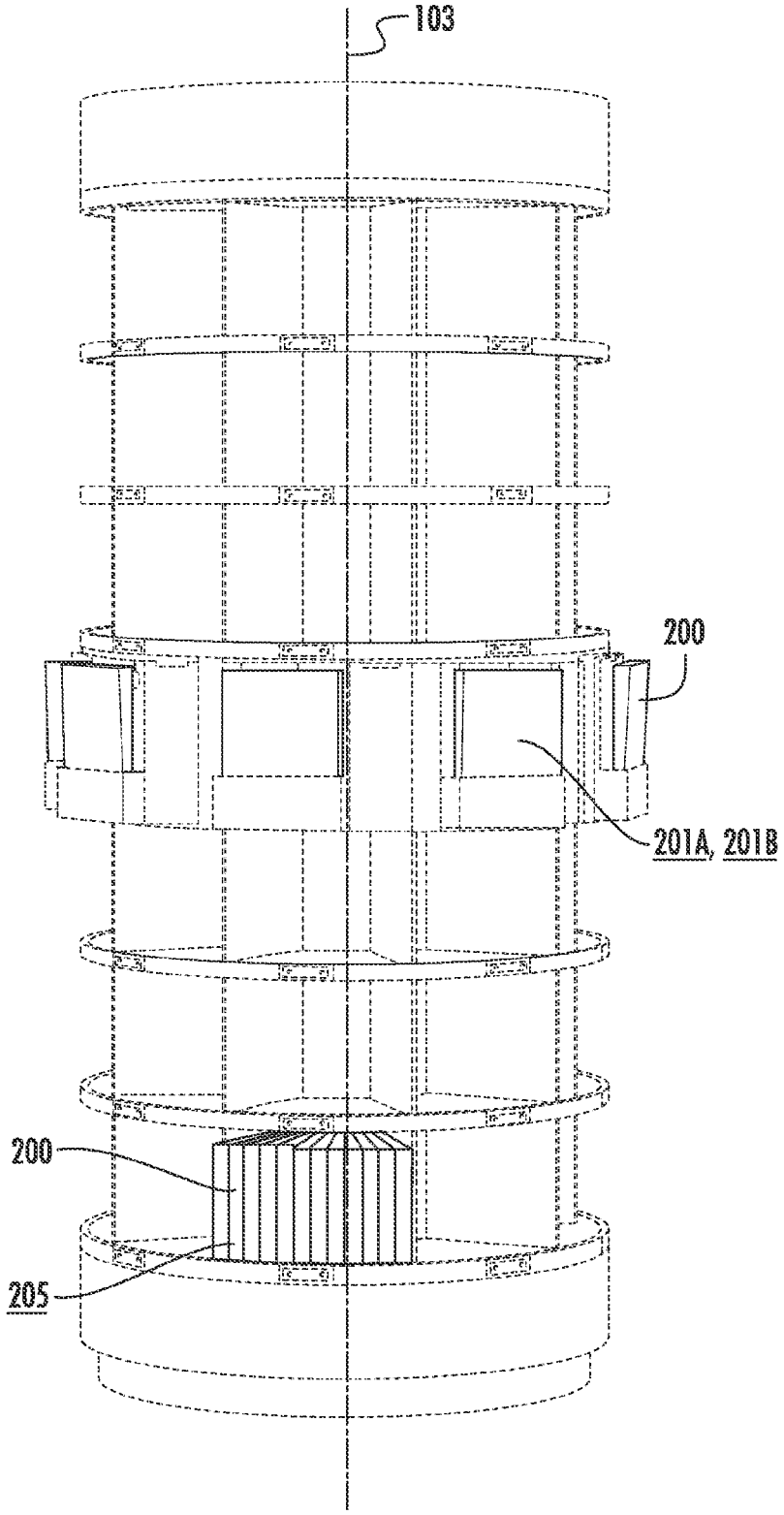
FIG. 12 is a perspective view of an example product package arrangement.

FIG. 12 also provides an illustrated example of product packages 200 arranged around a central axis 103 such that a side surface 201A, 201B (display surface) of the product package 200 faces away from the central axis 103. In the present example, the side surface 201A, 201B (display surface) of the product packages 200 can both face away from and be substantially parallel to the central axis 103.

In operation, the storage unit 100 described above can be used by providing a plurality of product packages 200 to the storage unit 100. The product packages 200 can be arranged on the top surface 111 of a shelving unit 110, around the central axis 103 of the storage unit 100, such that a spine surface 205 of the product packages 200 face away from the central axis 103. When arranged on the shelving unit 110, the product packages 200 may be configured such that the side surface 201A, 201B of adjacent product packages are adjacent to (and/or contacting) each other. Product packages 200 can also be arranged with respect to a storage space 124 provided on a shelving unit 110. For example, product packages 200 can be arranged parallel to the dividers 120. In one example, product packages 200 can be arranged around the central axis 103 at varying heights from the base 105 and at various spacing.

The storage unit 100 can further be used to arrange an additional product package in a display case 130 coupled to the storage unit 100 such that a side surface 201A or 201B (display surface) faces away from the central axis 103. The product package 200 can also be positioned in the display case 130 such that the side surface 201A or 201B (display surface) is substantially parallel to the central axis 103.

The storage unit 100 can be used to store/display product packages 200 located only on the shelving unit 110 or only in the display case 130 as described above. It is further contemplated, that the storage unit 100 can be used to store/display product packages located on both the shelving unit 110 and in a display case 130.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A product storage unit comprising:

a plurality of cylindrical shelving units arranged vertically along a central axis, each of the plurality of cylindrical shelving units comprising a top surface and opposing bottom surface, and an outer surface defining a perimeter of both the top surface and bottom surface;

at least one divider extending between the top surface of a first cylindrical shelving unit of the plurality of cylindrical shelving units and the bottom surface of a second cylindrical shelving unit of the plurality of cylindrical shelving units, the divider extending in a radial direction away from the central axis, and the divider defining a storage space sized and configured to receive a plurality of product packages;

a display case coupled to the outer surface of at least one of the plurality of cylindrical shelving units, wherein the display case is configured to display a product package placed therein; and a wedge insert having a first surface, a second surface and an edge such that first surface and the second surface are joined at the edge and defining an interior angle between the first and second surface, wherein the interior angle is determined such that the display surface of a product package received by the display case is urged in a direction substantially parallel to the central axis.

2. The product storage unit of claim 1, wherein each of the plurality of cylindrical shelving units includes a slot sized and configured to receive a portion of the divider.

3. The product storage unit of claim 1, wherein the storage space defines a wedge-shaped area.

4. The product storage unit of claim 1, wherein each of the plurality of cylindrical shelving units has an opening sized and configured to receive a central post, the central post positioned axially along the central axis.

5. The product storage unit of claim 1, wherein at least one of the plurality of cylindrical shelving units includes a retaining edge extending from the top surface of the at least one cylindrical shelving unit.

6. The product storage unit of claim 1, wherein the display case comprises a cavity configured to receive a product package.

7. The product storage unit of claim 6, wherein the wedge insert is configured to physically bias a product package toward an inner wall of the cavity.

8. The product storage unit of claim 7, wherein the cavity comprises a holding volume sufficient to contain a product package, and wherein placement of the display case insert within the cavity reduces the cavity holding volume by at least 20%.

9. The product storage unit of claim 1, wherein the display case is coupled to the outer surface of the at least one of the plurality of cylindrical shelving units such that the storage space within at least one of the shelving units remains accessible.

10. The product storage unit of claim 1, wherein the display case is positioned entirely outside of the storage space.

11. The product storage unit of claim 1, wherein the display case is coupled to the outer surface of the cylindrical shelving unit via an intermediate material or a coupling feature.

* * * * *